US008617038B2

(12) United States Patent
Batiste et al.

(10) Patent No.: US 8,617,038 B2
(45) Date of Patent: Dec. 31, 2013

(54) PORTABLE EXERCISE APPARATUS AND METHOD

(76) Inventors: Stan Batiste, Granite Bay, CA (US); Steven Achstein, Roseville, CA (US)

( * ) Notice: Subject to any disclaimer, the term of this patent is extended or adjusted under 35 U.S.C. 154(b) by 482 days.

(21) Appl. No.: 12/961,890

(22) Filed: Dec. 7, 2010

(65) Prior Publication Data

US 2011/0136634 A1 Jun. 9, 2011

Related U.S. Application Data

(60) Provisional application No. 61/283,733, filed on Dec. 7, 2009.

(51) Int. Cl.
*A63B 21/045* (2006.01)

(52) U.S. Cl.
USPC ..... 482/127; 482/92; 482/121

(58) Field of Classification Search
USPC ..... 482/1–130, 148, 905, 910; 434/247
See application file for complete search history.

(56) References Cited

U.S. PATENT DOCUMENTS

| | | | | |
|---|---|---|---|---|
| 4,625,961 | A * | 12/1986 | Brand | 482/116 |
| 7,008,354 | B2 | 3/2006 | Wen | |
| 7,182,718 | B2 * | 2/2007 | Wu | 482/122 |
| 7,955,237 | B2 * | 6/2011 | Bisson | 482/126 |

* cited by examiner

*Primary Examiner* — Glenn Richman
(74) *Attorney, Agent, or Firm* — Weide & Miller, Ltd.

(57) ABSTRACT

The improved exercise apparatus comprises a housing assembly having first and second arm members. The apparatus may be used to perform a variety of full body exercises generally by moving the first and second arms about an axial stem of the housing assembly. In one embodiment, the arm members rotate or pivot about the axial stem. A tension assembly provides resistance to the movement of the arm members while a positioning assembly allows the arm members to be positioned and secured in various positions relative to one another. One or more handle attachments may be provided to allow the apparatus to be grasped or used in various ways. A method of training various portions of the body with the apparatus is also provided herein.

15 Claims, 24 Drawing Sheets

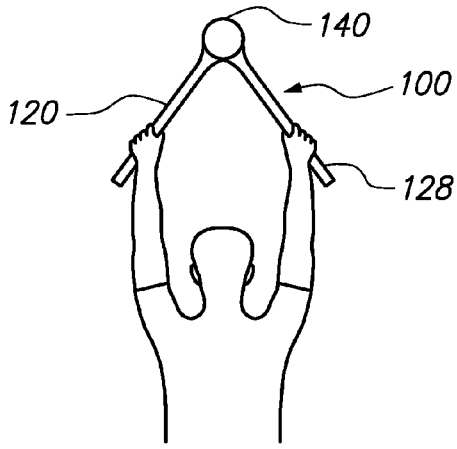
FIG. 8A
FIG. 9A
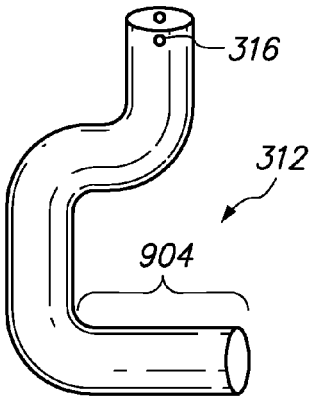
FIG. 9B
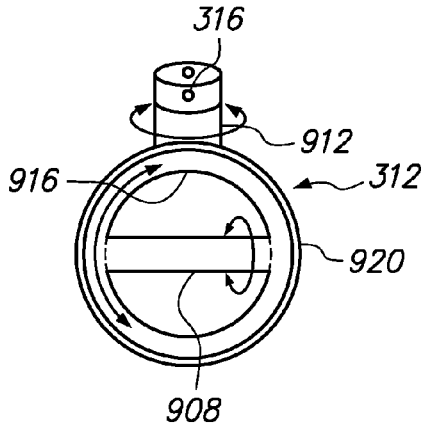
FIG. 9C
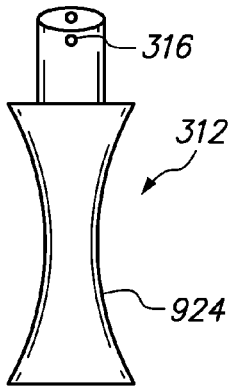

PORTABLE EXERCISE APPARATUS AND METHOD

CROSS-REFERENCE TO RELATED APPLICATION

This application claims priority to U.S. Provisional Application No. 61/283,733 titled Portable Exercise Apparatus and Method, filed Dec. 7, 2009.

BACKGROUND OF THE INVENTION

1. Field of the Invention

The invention relates to exercise equipment and in particular to an improved adjustable resistance portable exercise apparatus.

2. Related Art

There are numerous prior art designs for devices designed to exercise the body.

The prior art constructions are uniformly deficient with regard to not only the viability of the resistance provided by the apparatus; but also the lack of adjustability of the apparatus to allow a user to perform a wide variety of full body exercises.

Up until the present time, exercise apparatus only allowed a limited range of exercises to be performed due to the relatively fixed position of conventional exercise apparatus.

As a consequence of the foregoing situation, there has existed a longstanding need among those individuals who are genuinely concerned about physical fitness for a new type of exercise apparatus which provides not only for variable resistance but also a wide range of flexibility with regard to the initial positioning of the arms of the apparatus.

SUMMARY OF THE INVENTION

The exercise apparatus allows a user to train muscles and other structures of his or her body. In one embodiment, the apparatus generally provides two arm members which a user may engage, such as by grasping the arm members, and move to perform exercises. The apparatus may also be used to exercise other parts of a user's body as well. As described herein, a user may easily adjust the amount of resistance or force provided by the apparatus, the position of the arm members, or both as desired.

The exercise apparatus may have various configurations. For example, in one embodiment an exercise apparatus may comprise a housing assembly having a first housing unit and a second housing unit, an axial stem extending from the first housing unit to the second housing unit, and a tension drum having a central opening and one or more positioning holes. The tension drum may be rotatably mounted on said axial stem by said central opening;

A first arm comprising a hollow body may extend outward from the first housing unit. An elastic member may be within the hollow body of the first arm. A first portion of the elastic member may be secured to a portion of the first arm, and a second portion of the elastic member may be attached to the tension drum. In this manner, the elastic member may be stretched between the first portion and second portion to provide resistance to a user during exercise.

It is noted that the elastic member may be attached to the tension drum by an attachment cable. The elastic member may comprise a plurality of adjustment holes configured to secure the first portion of the elastic member to the first arm by accepting a securing pin therein. The first arm may comprise one or more openings through which the securing pin may enter the hollow body of the first arm.

A second arm comprising a hollow body may extend outward from the second housing unit. A retractable pin may be within the hollow body of the second arm. The retractable pin may be configured to insert into one of the one or more positioning holes to secure the second arm member in position relative to the second housing unit. The second arm may have a movable switch configured to allow the user to retract the retractable pin. A support rod located within the hollow body of the second arm may connect the movable switch to the retractable pin.

Various handles may be used with the exercise apparatus if desired. For example, the exercise apparatus may have a first handle and a second handle. The first handle may be removably secured to a distal end of the first arm, while the second handle may be removably secured to a distal end of the second arm. It is noted that a first handle may comprise a user graspable bar mounted to the distal end of the first arm by a rotating mount.

In another exemplary embodiment, an exercise apparatus may comprise a housing comprising a first portion and a second portion. The first portion may be rotatable relative to the second portion. An axle may be within the housing and extend between the first portion and the second portion of the housing. A tension drum having an opening therein to rotatably mount the tension drum to the axle may be within the housing as well.

A first arm may extend from the first portion of the housing. A resilient member may be secured at a first point to the first arm and connected at a second point to the tension drum. The resilient member may be mounted external to the first arm, or the resilient member may be within a hollow section of the first arm. The resilient member may have a plurality of adjustment holes configured to accept a securing pin to secure the resilient member to the first arm at the first point of the resilient member. The first arm may have a plurality of openings through which a securing pin may be inserted into the resilient member to secure the resilient member to the first arm at the first point of the resilient member.

A second arm may extend from the second portion of the housing. The tension drum may be secured to the second arm such that the tension arm rotates with the second arm. The tension drum may have one or more openings and be secured to the second arm by a retractable pin that is insertable into the one or more openings. The tension drum may be cylindrical in shape. The resilient member may be connected to the tension drum by a cable.

Various methods for exercising with the exercise apparatus are disclosed herein as well. For example, in one embodiment a method for exercising with the exercise apparatus may comprise engaging a first arm of the exercise apparatus with a first body part, and engaging a second arm of the exercise apparatus with a second body part, the first arm and second arm rotatably attached at their proximal ends. Some exemplary body parts which may engage the exercise apparatus include a user's hand, foot, back, chest, arm, buttocks, leg, and thigh.

A resilient member may then be stretched by rotating the tension drum by rotating the second arm relative to the first arm in a first direction. This is because the resilient member may be attached at a first point to the first arm and at a second point to the tension drum. The resilient member may then be contracted by reducing force on the first arm to permit the second arm to rotate relative to the first arm in a second direction (the second direction distinct from the first direction).

A securing pin may be inserted into an opening of the resilient member to secure the first point of the resilient member to the first arm. A pin may be inserted into an opening of the tension drum to secure the second arm to the tension drum. Various handles may be used with the exercise method as well. For example, a first handle may be attached to a distal end of the first arm. Once the first handle is attached, the first body part may engage the first arm via the first handle.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIGS. 8A-8C illustrate exemplary upper body exercises performed with an exemplary exercise apparatus;

FIGS. 9A-9F are a perspective views illustrating an exemplary handle attachments;

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
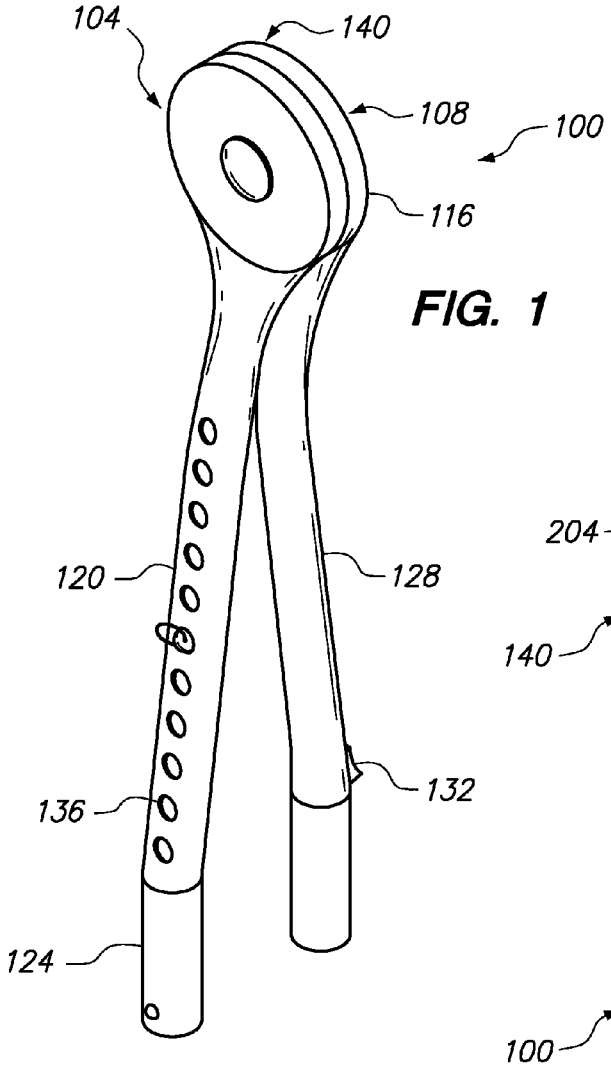
FIG. 1 is a perspective view of an exemplary exercise apparatus.

As can be seen by reference to the drawings, and in particular to FIG. 1, the improved exercise apparatus that forms the basis of the present invention is designated generally by the reference numeral 100. The apparatus 100 may provide full body exercise through its arm members 120,128 which may rotate or pivot relative to one another. For example, a user may grasp the arm members 120,128 with his or her hands and perform upper body exercise by rotating the arm members 120,128. Of course, other portions of the body may be trained by engaging the arm members 120,128. In one or more embodiments, the apparatus 100 utilizes an elastic tension assembly to provide resistance to a user's body during exercise.

In one or more embodiments, the apparatus 100 may comprise a housing assembly 140 which may enclose one or more components of the apparatus. The housing assembly may comprise a first housing unit 104 and a second housing unit 108. As illustrated in FIG. 1, the housing units are generally cylindrical in shape. Various shapes may be used however. As will be described, the housing units 104,108 may rotate relative to one another, such as about an axial stem. A first arm member 120 may extend outward from the first housing unit 104, and a second arm member 128 may extend from the second housing unit 108. As shown, the arm members 120, 128 extend radially from their respective housing assemblies 104,108.

The arm members 120,128 may be tubular in shape having a circular or other shaped cross section. In one embodiment, the arm members 120,128 may be hollow. The lower ends of the arm members 120,128 may include a handle portion 124 if desired. The handle portion 124 may be configured to allow a user to grasp the arm members 120,128 more easily. For example, the handle portion 124 may comprise a rubber or other grip in one or more embodiments.

Figure 3A:
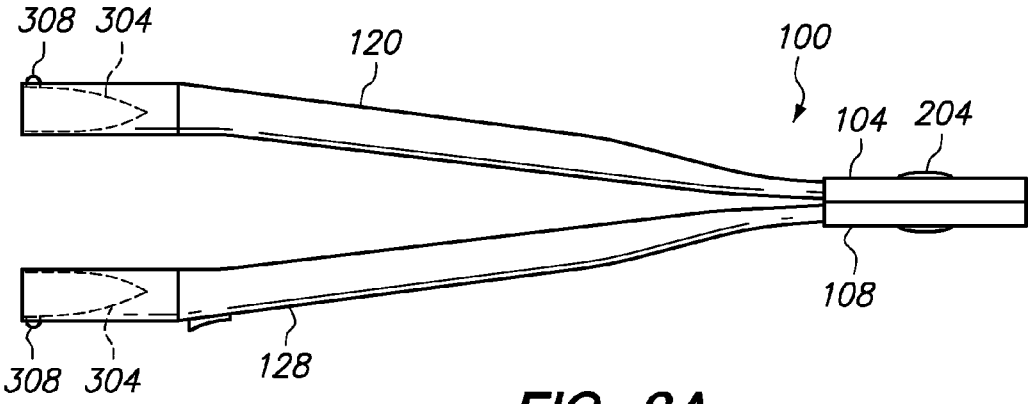
FIGS. 3A-3B are side cross section views of an exemplary exercise apparatus illustrating attachment of a handle attachment.
Figure 3B:
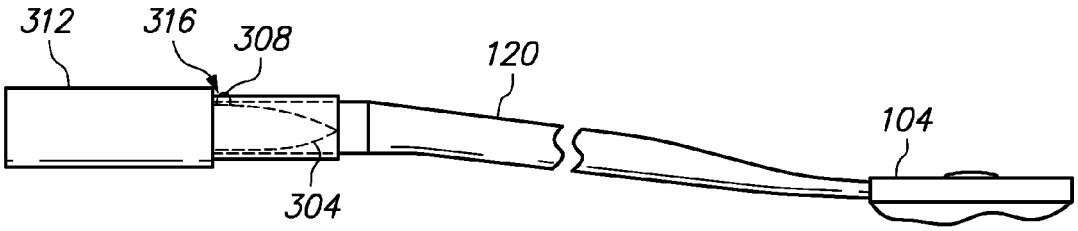

FIG. 3A illustrates a cross section view of the apparatus 100 showing a spring pin 304 within the arm members 120, 128 of the apparatus to allow removable attachment of a handle attachment. In general, a handle attachment provides various grips and/or extensions which the user may grasp to use the apparatus 100. In the embodiment of FIG. 3B, the handle attachment 312 increases the length of the arm member 120 which is advantageous because it changes the amount of resistance provided by the apparatus 100 and also because it allows the apparatus to accommodate users with longer arms. The handle attachment 312 may also provide a padded or soft grip for user comfort during exercise. As will be described further below with regard to the operation of the apparatus 100, various types of handle attachments 312 having various benefits may be used.

The spring pin 304 may be configured as a "V" shaped spring comprising a locking protrusion 308 at one or both of its two ends as shown in FIG. 3A-3B. The locking protrusion 308 may extend outward from the arm members 120,128 by the outward force provided by the spring pin 304. As shown in FIG. 3B, a portion of a handle attachment 312 may be placed over an arm member 120,128 allowing the locking protrusions 308 to extend through one or more locking holes 316 of a handle attachment 312. This allows handle attachments 312 to be secured to the arm members 120,128. It is noted that other springs or devices may be used to push a locking protrusion 308 outward. For example, a coil spring may be used in one or more embodiments. In other embodiments, a resilient material bent within the arm members 120,128 may be used to push the locking protrusion 308 outward.

The spring pin 304 allows a locking protrusion 308 to be pressed inward by a user. In this manner, a handle attachment 312 may be released from its attachment with an arm member 120,128. A different handle attachment 312 may then be attached to the apparatus, or the user may exercise without handle attachments if desired.

Figure 2A:
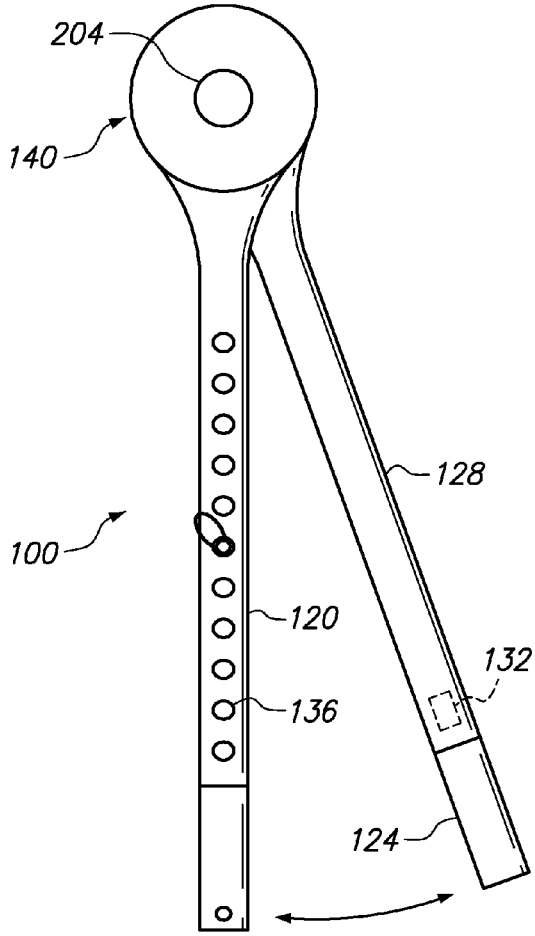
FIG. 2A is a front view of an exemplary exercise apparatus.

As will be described further below, one or more of the arm members 120,128 may include one or more tension adjustment holes 136 to adjust the amount of force provided by the apparatus 100, a position adjustment switch 132 to adjust the position of an arm member, or both. As illustrated in FIGS. 1 and 2A, the adjustment holes 136 and switch 132 may be located at various locations along the sides of the arm members 120,128.

Figure 2B:
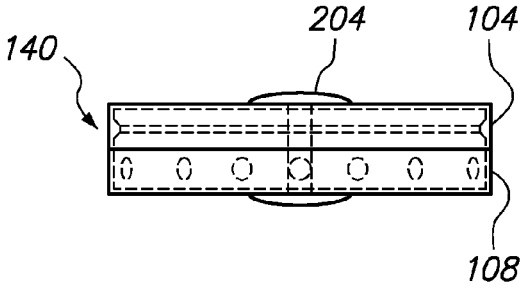
FIG. 2B is a side cross section view of an exemplary housing assembly.

As shown in FIGS. 2A and 2B, the arm members 120,128 may rotate relative to one another about an axial stem 204 in one or more embodiments. The axial stem 204 may extend into or through a central portion of the housing units 104,108 to permit such rotation of the arm members 120,128. In the embodiment of FIG. 2B, the axial stem 204 extends through the housing units 104,108 to allow the housing units and their attached arm members 120,128 to rotate about the axial stem. As will be described further below, a tension drum (as can be seen in FIG. 2B within the housing assembly 140) may also rotate about the axial stem 204.

It is noted that other configurations of the axial stem 204 may be provided. To illustrate, the axial stem 204 may extend through a first housing unit 104 to a second housing unit 108 without extending through the second housing unit in one or more embodiments. For example, the axial stem 204 may extend through a first housing unit 104 and to a second housing unit 108. The axial stem 204 may be attached to the second housing unit 108. In this manner, the housing units 104,108 may still rotate relative to one another.

Figure 4A:
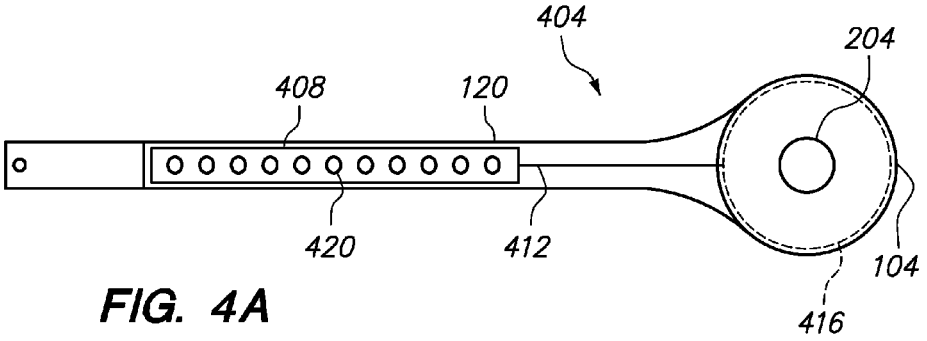
FIG. 4A-4B are top cross section views illustrating exemplary tension assemblies.

Resistance to the rotation of the arm members 120,128 may be provided by a tension assembly in one or more embodiments. As shown in the cross section view of FIG. 4A, the tension assembly 404 may comprise a tension member 408 having an attachment cable 412 and a tension drum 416. As can be seen, portions of the tension assembly 404 may be disposed within the first housing unit 104 and first arm member 120.

Figure 4B:
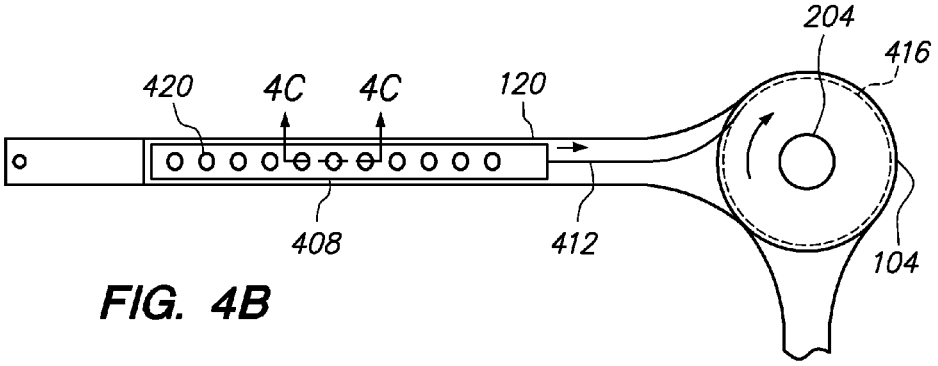

In one or more embodiments, the tension member 408 may be connected to the tension drum 416 by the attachment cable 412. In this manner, rotation of the tension drum 416 causes the tension member 408 to stretch thereby providing resistance to the rotation of the tension drum. This is illustrated in FIG. 4B. As stated above, the tension drum 416 may include a central opening to allow the tension drum to rotate about the axial stem 204 in one or more embodiments.

It is contemplated that one or more pulleys 460 or the like may be used to guide the attachment cable from the tension member 408 to the tension drum 416. In general, the pulleys will be within the arm member 120 and be used to prevent the attachment cable 412 from contacting or rubbing against internal portions of the arm member and to prevent the cable from becoming tangled or kinked. It will be understood that various rotating and fixed structures may be used to guide the attachment cable 412 in one or more embodiments. The pulleys 460 are not required however and may not be provided in all embodiments.

Typically, but not always, the tension member 408 will be formed from elastic material which allows the tension member 408 to stretch and then return to its original shape. It is contemplated that various elastic materials may be used, alone or in combination, to form the tension member 408. For example, natural or synthetic rubber may be used to form the tension member 408. The tension member 408 may be a preloaded spring cartridge in one or more embodiments. For example, the tension member 408 may comprise a spring contained in a housing that attaches and provides resistance as a single enclosed unit. The spring may be a standard or variable resistance spring and may be externally mounted.

As stated above, the amount of resistance or force provided by the tension member 408 may be adjustable. In one or more embodiments, the tension member 408 may have one or more openings 420. As shown in the cross section side view of FIG. 4C, the openings 420 may accept an adjustment pin 424 or securing pin that was first inserted into an adjustment hole 136 of a first arm member 120. This secures the tension member 408 in position within the first arm member 120.

Figure 4C:
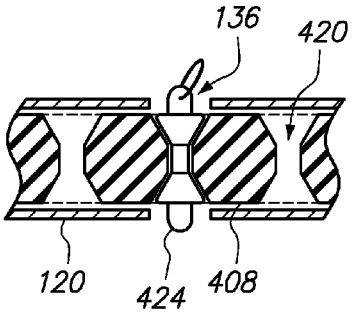
FIG. 4C is a side cross section view of an exemplary tension member and adjustment pin.

FIG. 4C illustrates an embodiment of the tension member 408 where the openings 420 are an hourglass shape. The adjustment pin 424 has a corresponding shape with a narrow middle portion and wider outer sections. This is advantageous in that it helps ensure that the adjustment pin 424 is securely retained once inserted. The adjustment pin 424 may still be easily removed from within an opening of the tension member 408 especially in embodiments the tension member is formed from elastic material. A loop is provided in the embodiment of FIG. 4C to make removing the adjustment pin 424 easy. Of course, a loop may not be provided in all embodiments.

Typically, but not always, the adjustment pin 424 will extend through the first arm member 120 and the tension member 408 to ensure that the tension member is secured. In these embodiments, a portion of the adjustment pin 424 may extend out the other side of a first arm member 120 as shown in FIG. 4C. It is noted that in some embodiments, the adjustment pin 424 may extend into but not through a tension member 408 as well. In addition, the openings 420 of a tension member 408 and the adjustment pin 424 may be various shapes. For example, the openings 420 and the adjustment pin 424 may be substantially straight, triangular or wedge shaped, rounded, or a combination thereof. In addition, the openings 420 and adjustment pin 424 may include one or more wider or narrower portions other than those illustrated in FIG. 4C.

Referring back to FIG. 4A, in general, securing the tension member 408 at a opening 420 further away from the tension drum 416 reduces the resistance provided by the tension member while securing the tension member closer to the tension drum increases such resistance. Thus, a user may set the resistance to a desired amount by accordingly inserting the adjustment pin 424 into an adjustment hole 136 and an opening 420 of the tension member.

Figure 4D:
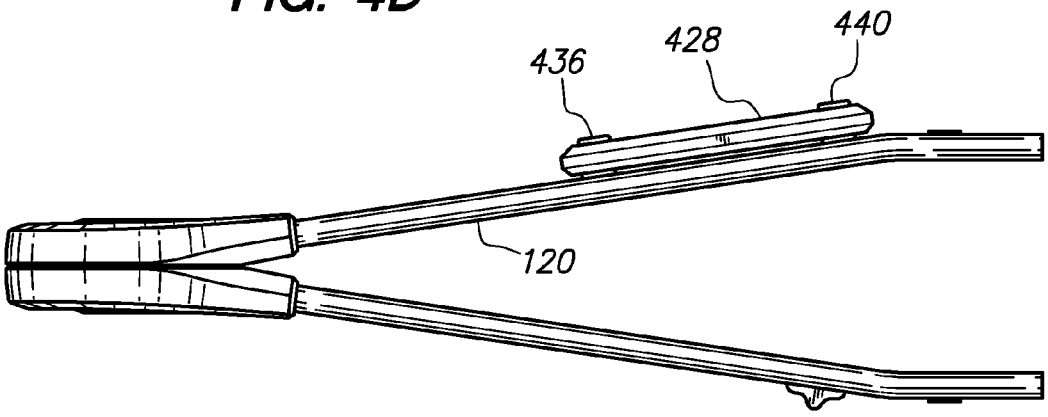
FIG. 4D is a side view of an exemplary external tension assembly.

The tension member may be external to the arm member in some embodiments. The exemplary exercise apparatus of FIG. 4D illustrates an external tension member 428. As can be seen, the external tension member 428 may be held by mounts 436,440. One of the mounts 436,440 may be fixed in position relative to the arm member 120 while the other mount may be movable. For example, a first mount 440 may be fixed while a second mount 436 is not. The second mount 436 may be connected to the tension drum 416, such as by an attachment cable 412 or the like. In this manner, movement of the arm members stretches the external tension member 428 such as described above with regard to the internal tension member.

Figure 4E:
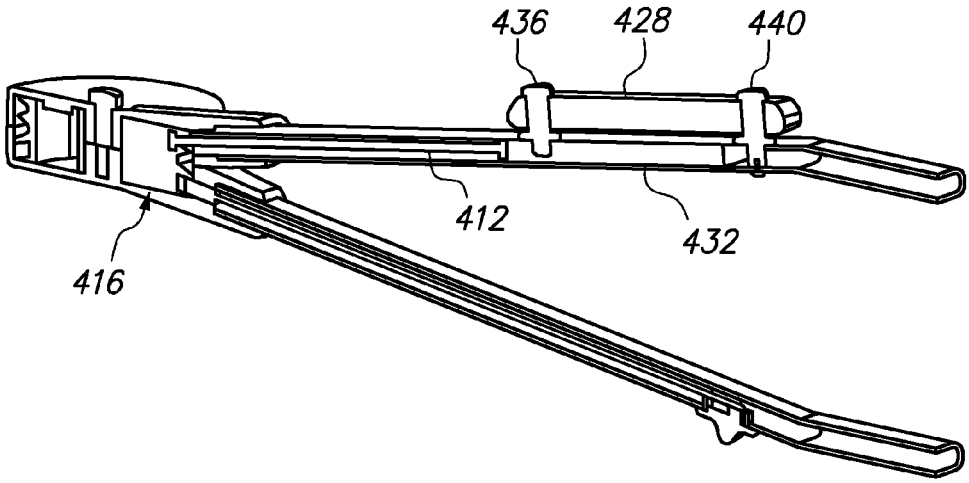
FIGS. 4E-4I are perspective views of exemplary external tension assemblies.
Figure 4F:
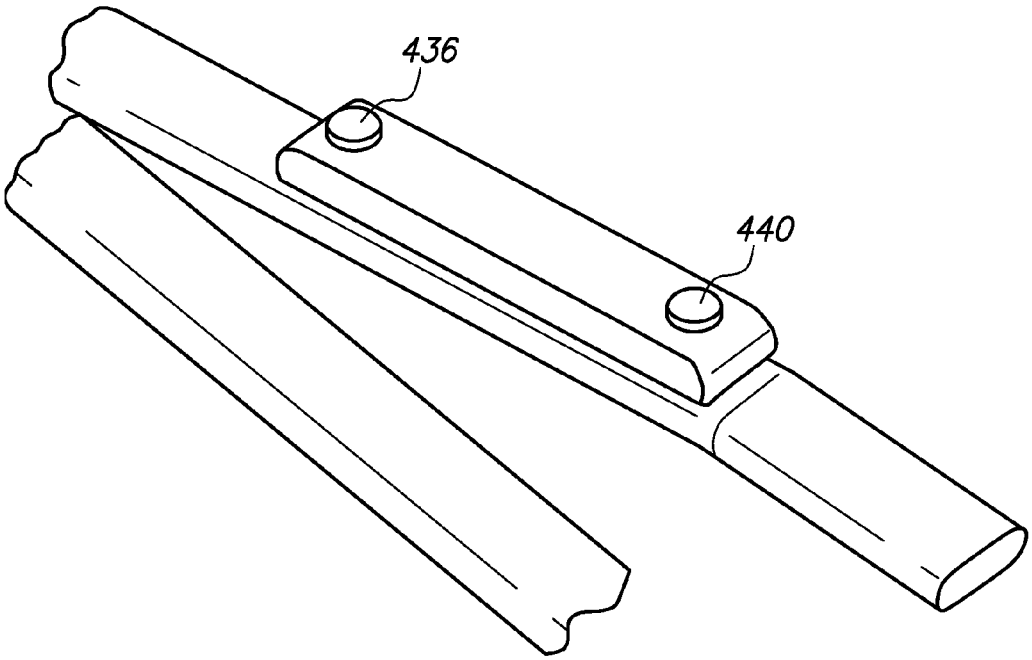

FIG. 4E illustrates a cross section view of the tension assembly comprising an external tension member 428. As can be seen the fixed mount 440 is fixed to the arm member 120, while the movable mount 436 is not. In one or more embodiments, the movable mount 436 may be coupled or attached to a slide 432 which can move or slide along an interior portion of the arm member 120. The slide 432 may be connected to the tension drum 416 by an attachment cable 412 or attachment bar to allow force applied to move the arm member(s) to be applied to the external tension member 428. As can be seen from FIG. 4F, the arm member 120 may comprise a slot or opening along its length to allow the movable mount 436 to move as the external tension member 428 is stretches and shrinks.

The resistance provided by an external tension member 428 may be adjusted by utilizing tension members of varying elasticity. This may be accomplished by removing one external tension member 428 and replacing it with another external tension member that provides the desired resistance. External tension members 428 may comprise one or more elastic materials to provide a variety of resistance levels. The external tension member 428 may be removed from the mounts 436, 440 and another external tension member may be placed onto the mounts 436,440.

Figure 4G:
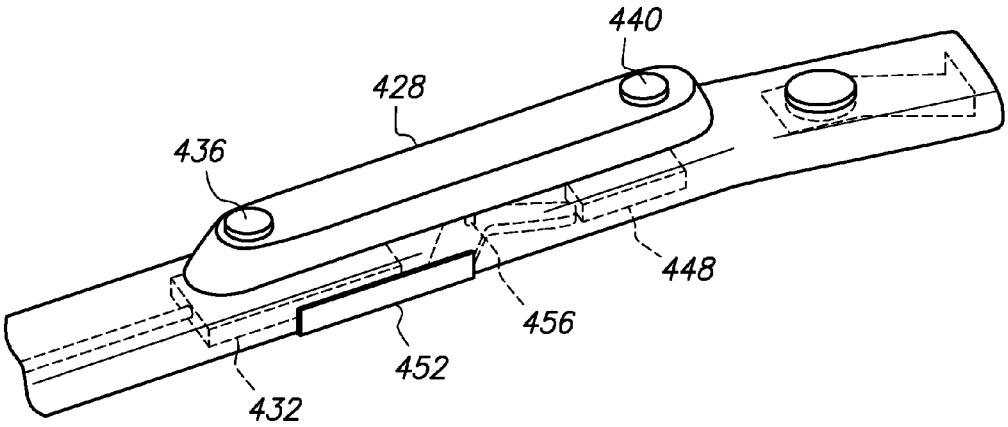

In some embodiments, the tension assembly may include a pretension mechanism which pre-stresses a tension member to eliminate any slack in the exercise apparatus, even when the arm members are in a neutral position. FIG. 4G is a top perspective view of a pretension mechanism that may be used with an external tension member 428. As shown, the pretension mechanism comprises a locking pretension bar 452 which works in combination with a block 448 to pre-stress the external tension member 428. The pretension bar 452 may rotate about a pivot 456 in one or more embodiments to push the block 448 to pre-stress the external tension member 428. The fixed mount 440 may be attached to the block 448. Thus, by moving the block 448, the pretension bar 452 pre-stresses the external tension member 428. It is noted that the arm member 120 may include a slot or opening at the fixed mount 440 to allow movement of the fixed mount which extends from an internal portion of the arm member 120 to the external tension member 428.

Figure 4H:
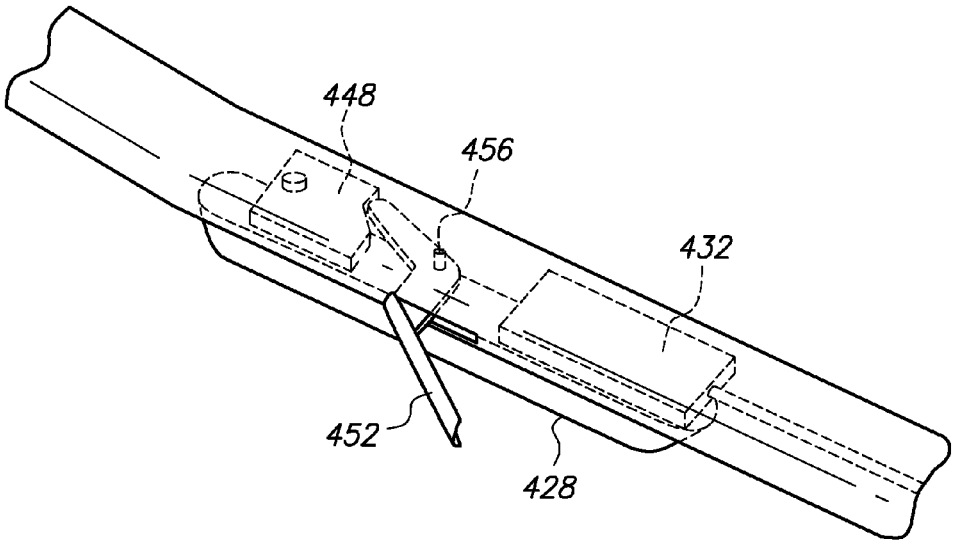
Figure 4I:
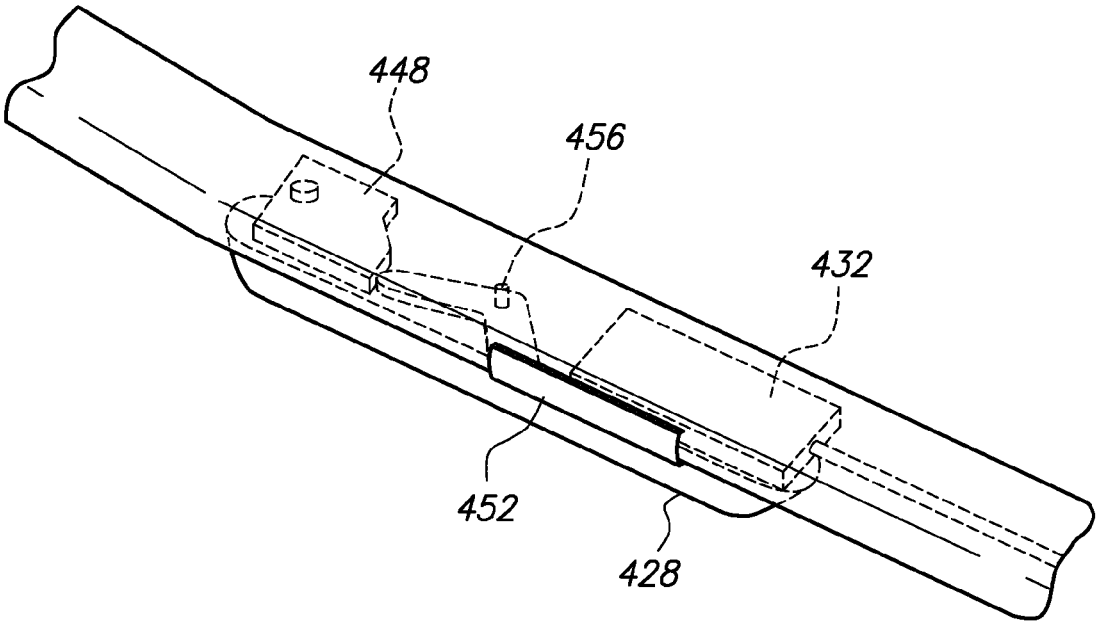

FIGS. 4H-4I illustrate bottom perspective views of the pretension mechanism in operation. In FIG. 4H the pretension bar 452 is open meaning that it is not pre-stressing the external tension member 428. As can be seen, the pretension bar 452 rotates about a pivot 456 which allows a portion of the pretension bar to act upon and move the block 448. The block may be shaped or contoured such that the rotation of the pretension bar 452 causes the block 448 to move in a direction which pre-stresses the external tension member 428. For example, as shown in FIG. 4H, the block 448 has a contoured section which causes the block to move as the pretension bar 452 is rotated, such as shown by the relative position of the block 448 in FIGS. 4H-4I. It is noted that the block 448 may include a indentation or the like in its contoured edge to lock the pretension bar 452 in position once the pretension bar is closed, such as shown in FIG. 4I. The indentation may be slight such that the pretension bar 452 may be dislodged from the indentation when the user wishes to open the pretension bar.

It is contemplated that the pretension mechanism may also be used when replacing external tension members. For example, the pretension mechanism may be opened to release an external tension member and/or allow the mounts to be positioned to accept another external tension member. The pretension mechanism may then be closed to pre-stress the newly installed external tension member.

Figure 5:
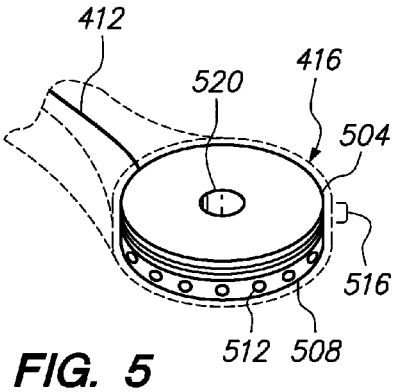
FIG. 5 is a perspective view of an exemplary tension drum.

FIG. 5 is a perspective view of an exemplary tension drum 416. As can be seen, the tension drum 416 may comprise a central opening 520, a first portion 504, and a second portion 508. The central opening 520 may be configured to accept a portion of the axial stem described above to allow the tension drum 416 to rotate within the housing unit of the apparatus. Though not required in all embodiments, it is contemplated that the central opening 520 may utilize one or more ball bearings or bushings to allow its rotation.

The first portion may include a cable guide 516 configured to accept a portion of the attachment cable 412 when the tension drum 416 is rotated. The cable guide 516 may be a groove or indentation formed along the edge of the first portion 504 of the tension drum 416. The cable guide 516 is beneficial in that it retains the attachment cable 412 as the tension drum 416 is rotated. This prevents the attachment cable 412 from contacting or becoming entangled with other components of the apparatus. It is contemplated that the first portion may also include one or more notches or openings to allow an attachment cable 412 or the like to be attached to the tension drum 416.

The second portion 508 of the tension drum 416 may be configured to secure the second arm member 128 at an angle or parallel to the first arm member 120, or vice versa. As shown, the second portion 508 comprises a series of positioning holes 512 along the edge of the second portion. As will be described further below, each positioning hole 512 generally corresponds to a position where the second arm member 128 may be secured. It will be understood that the positioning holes 512 may be spaced evenly or otherwise. Additional positioning holes 512 may be added to allow the second arm member 128 to be secured at additional positions relative the first arm member 120. Fewer positioning holes 512 than the amount shown may also be provided in some embodiments.

Figure 6A:
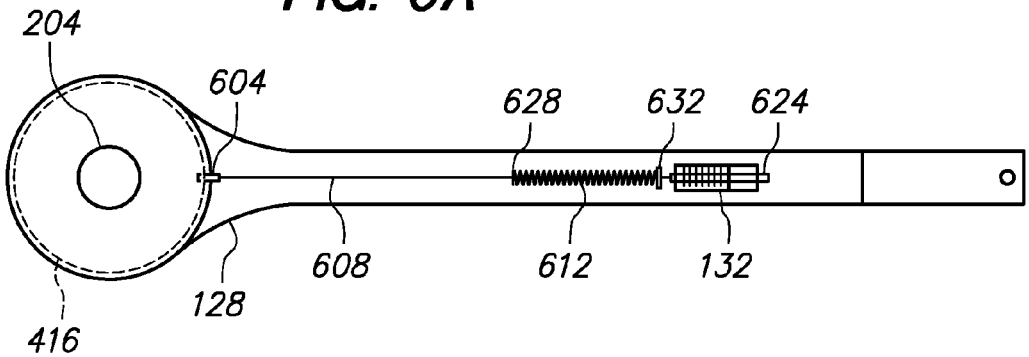
FIG. 6A is a top cross section view illustrating an exemplary positioning assembly securing an arm member.
Figure 6B:
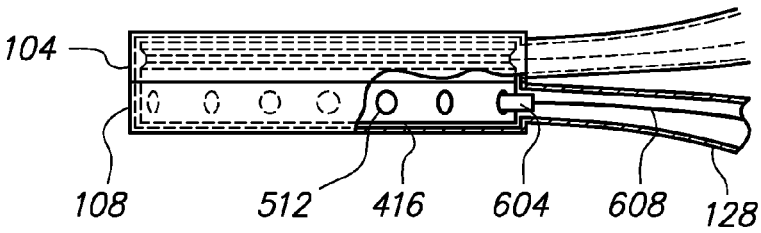
FIG. 6B is a side cross section view illustrating an exemplary positioning assembly securing an arm member.

As illustrated by FIGS. 6A and 6B, the positioning holes 512 accept a positioning pin 604 which may extend from the second arm member 128. In this manner, the positioning pin 604 secures the second arm member 128 at a position defined by a positioning hole 512.

In one or more embodiments, the positioning pin 604 may be part of a positioning assembly which allows the position of the second arm member 128 to be easily changed. As shown in FIG. 6A, the positioning assembly may comprise a switch 132 attached to an adjustment bar 608. The adjustment bar 608 may have the positioning pin 604 attached, or integrally formed, at an end opposite the switch 132. It is contemplated that the adjustment bar 608 may be formed from a substantially rigid material to allow movement of the switch 132 to be transferred along the adjustment bar 608 to move the positioning pin 604. It is contemplated that materials such as but not limited to metal, plastic, wood, alloys, and fiberglass may be used to form the adjustment bar 608.

The switch 132 may move along a switch guide 624. The switch guide 624 may comprise a groove, track, opening, or other structure which allows the switch 132 to move forward and backward. As shown in FIG. 6A, the switch moves along a switch guide 624 comprising an elongated track. In this embodiment, it can be seen that moving the switch 132 away from the tension drum 416 removes the positioning pin 604 from the tension drum. Likewise, moving (or releasing) the switch 132 toward the tension drum 416 extends the positioning pin 604 outward from the second arm member 128. As will be described further below, this retraction and extension allows the positioning pin 604 to be removed from and inserted into a positioning hole of the tension drum 416.

In one or more embodiments, the switch assembly may be spring loaded by one or more springs 612. The force of the spring 612 may be applied to push or pull a positioning pin 604 into or out of a positioning hole. As shown in FIG. 6A, the spring 612 is attached at a first end 628 to the adjustment bar 608 and at a second end 632 to a mount which may be attached to a portion of the second arm member 128. In this manner, the spring 612 may provide a force which pushes the positioning pin 604 into a positioning hole. This makes adjustment and securing of the second arm member's 128 position easier because the positioning pin 604 will automatically be pushed into a positioning hole.

In addition, the spring 612, through the adjustment bar 608, provides resistance to the motion of the switch 132. To illustrate, moving the switch 132 away from the tension drum 416 pulls the adjustment bar 608 which compresses the spring 612. In this manner, the user experiences some resistance when moving the switch 132. When the switch 132 is released, the spring 612 moves the switch 132 (and the adjustment bar 608 and positioning pin 604) towards the tension drum 416. This allows the switch 132 to automatically return once released and places tension on the switch holding it in place when not in use.

It is noted that the spring 612 may be attached at various portions of the switch assembly if desired. For example, the spring 612 may be attached to the positioning pin 604 at one end and to a portion of the second arm member 128 at another end in some embodiments. In this configuration, the spring 612 is also able to push the positioning pin 604 and the attached adjustment bar 608 and switch 132 toward the tension drum 416. It is contemplated that other configurations which push or pull the positioning pin 604 and attached components towards the tension drum 416 may be used in various embodiments.

Figure 6C:
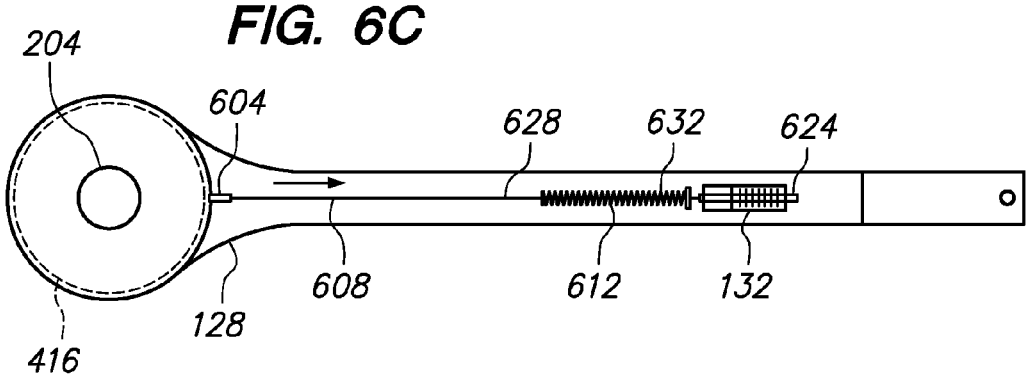
FIG. 6C is a top cross section view illustrating an exemplary positioning assembly with an unsecured arm member.
Figure 6D:
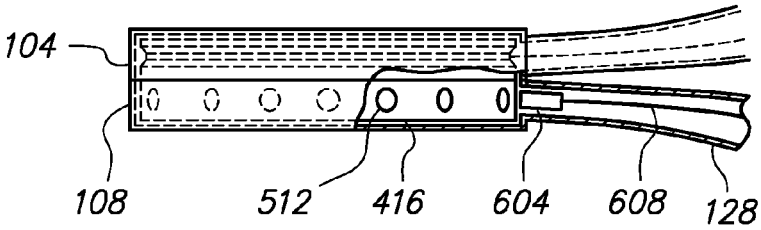
FIG. 6D is a side cross section view illustrating an exemplary positioning assembly with an unsecured arm member.

FIG. 6B provides a better view of the positioning pin 604 being accepted by a positioning hole 512. FIG. 6C illustrates retraction of the positioning pin 604 from a positioning hole. As can be seen, the switch 132 has been moved away from the tension drum 416, compressing the spring 612, and also moving the positioning pin 604 out of a positioning hole 512 as can be seen in FIGS. 6C and 6D.

Once the positioning pin 604 is out of a positioning hole 512, the second arm member 128 is no longer secured relative to the first arm member. Thus the second arm member 128 may be rotated until a desired position is reached. The positioning pin 604 may then be reinserted into a positioning hole 512 to once again secure the second arm member 128. In a spring loaded embodiment, a spring 612 may push or pull the positioning pin 604 into a positioning hole 512 once the user releases the switch 132. In non-spring loaded embodiments, the user may move the switch 132 towards the tension drum 416 to reinsert the positioning pin 604 in a positioning hole 512. As shown by FIGS. 6A and 6B, the position of the second arm member 128 is secured by the positioning pin 604 once inserted into a positioning hole 512.

Figure 7A:
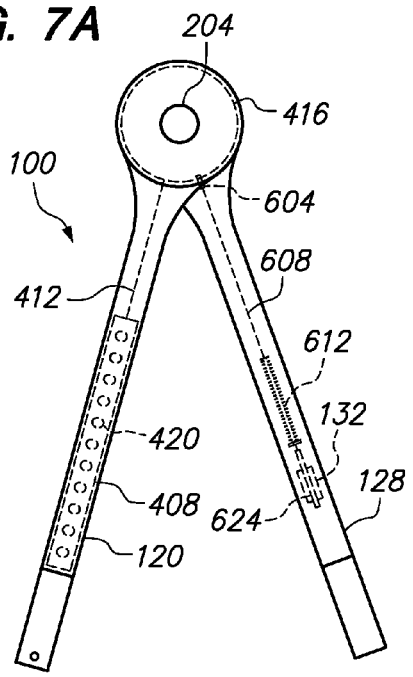
FIGS. 7A-7C are top cross section views illustrating an exemplary exercise apparatus in operation.
Figure 7B:
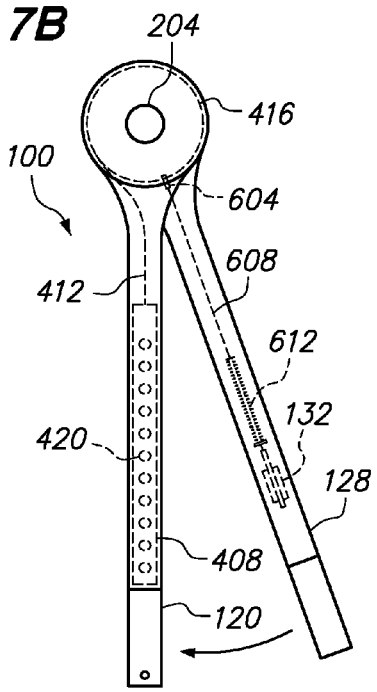
Figure 7C:
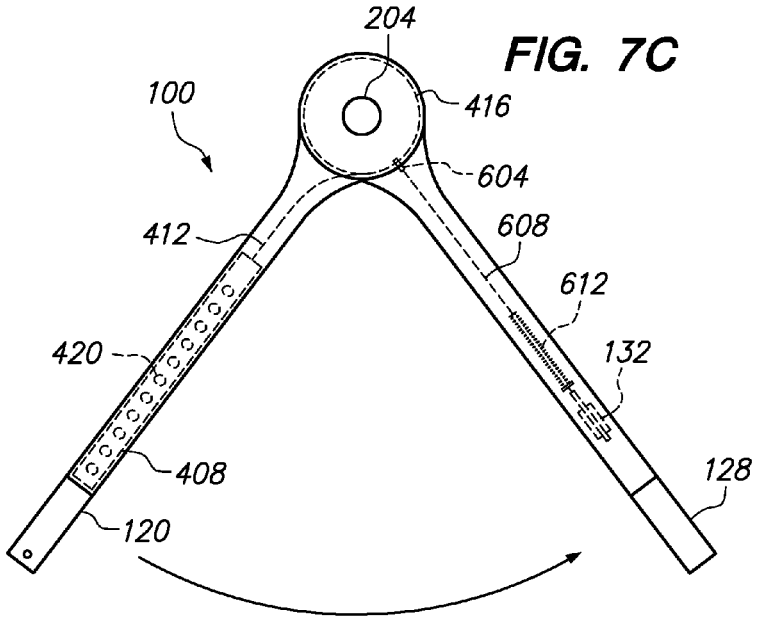

FIGS. 7A-7C illustrate the apparatus in operation. In FIG. 7A, the apparatus is in a neutral position. As shown, the second arm member 128 is secured at an angle relative to the first arm member 120 by the positioning pin 604 and a positioning hole 512. Of course, the arm members may be secured at various angles including parallel angles (e.g. 0 or 180 degrees). The apparatus may be considered in a neutral position when the arm members 120,128 have not been moved. In this position, the elastic tension member 408 will generally not be stretched. Of course, the elastic tension member 408 may be partially stretched in the neutral position to provide at least some tension on the attachment cable 412. This is advantageous because it prevents the second arm member 128 from wobbling relative to the first arm member 120 when in the neutral position.

As shown in FIGS. 7B and 7C, the arm members 120,128 may be moved to perform upper body exercises. In FIG. 7B, the arm members 120,128 are moved toward one another as indicated by the arrow. As the second arm member 128 moves, the positioning pin 604, which is inserted in a positioning hole 512, causes the tension drum 416 to rotate. This rotation in turn pulls the attachment cable 412 stretching the elastic tension member 408 which provides resistance to the user's movement of the arm members 120,128. This provides training to the user's upper body muscles and other structures.

The benefit of a cable guide 516, as illustrated in FIG. 5, can also be seen. As the tension drum 416 rotates, the attachment cable 412 may wrap around the tension drum. The cable guide 516 ensures that the attachment cable 412 wraps around the tension drum 416 properly.

In FIG. 7C, the arm members 120,128 are moved away from one other as indicated by the arrow. Similar to the above, as the second arm member moves, the positioning pin 604 causes the tension drum 416 to rotate. This rotation pulls the attachment cable 412 which stretches the tension member 408 thus providing resistance to a user.

As the user reduces the force applied to move the arm members 120,128, the tension member 408 retracts pulling the arm members back to the neutral position. As can be seen from the figures, this occurs regardless of whether the arm members 120,128 have been moved apart from one another or closer to one another. Once at the neutral position again, the user may repeat his or her prior motion to move the arm members 120,128 apart or closer together. The user may resist the force from the tension member 408 as the arm members 120,128 return to the neutral position. In this manner upper body training also occurs as the arm members 120,128 move back to the neutral position.

It is contemplated that the user may also continue his or her motion after the neutral position has been reached. For example, a user may first move the arm members 120,128 apart from the neutral position and then allow the arm members to return to the neutral position. Instead of moving the arm members 120,128 apart again, the user may continue his or her motion causing the arm members to move even closer together. It will be understood that the same may be performed by the user where the user starts by moving the arm members 120,128 closer together.

Generally, a user will grasp the apparatus as shown in FIG. 8A, to perform upper body exercise. As can be seen, the user is holding each arm member 120,128 with his or her hands. The user may grasp the arm members 120,128 at a handle portion 124 or at other locations. As shown in FIG. 8A, the user is holding the apparatus with the housing assembly 140 above the arm members 120,128. Of course, the user may hold the apparatus with the housing assembly 140 below the arm members 120,128 during exercise as well. It will be understood that a user may hold the apparatus at various other positions during exercise as well.

Figure 8B:
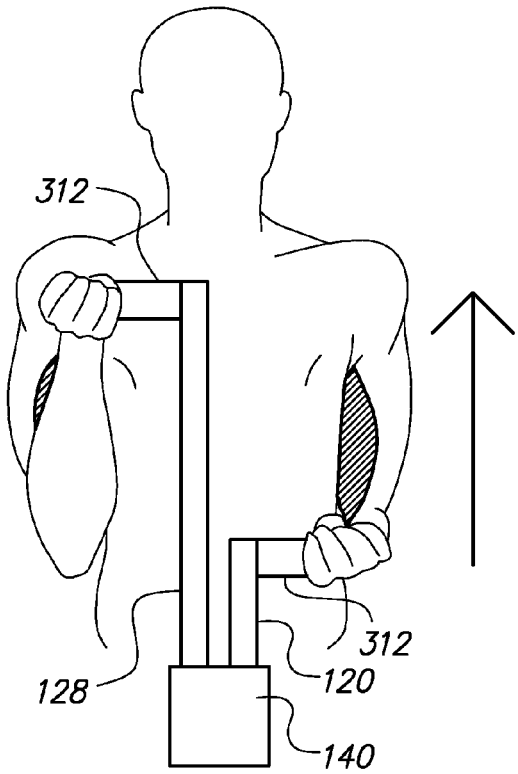
Figure 8C:
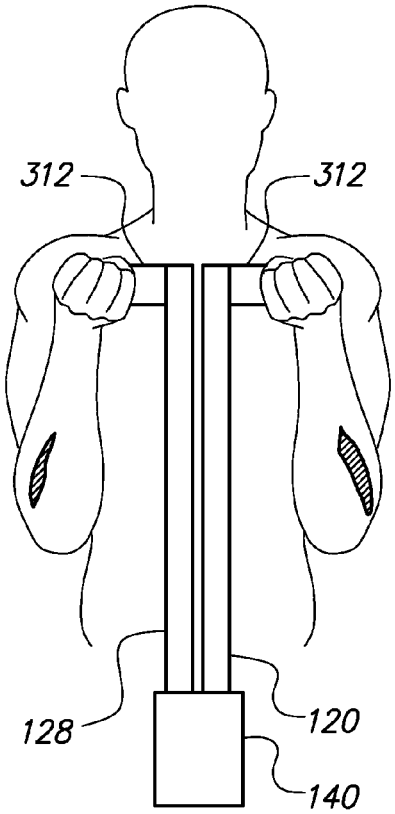

FIGS. 8B-8C illustrate another upper body exercise that may be performed. Muscles or muscle groups that may be used/trained during an exercise are shaded in the figures. For this exercise, the exercise apparatus may be configured with a perpendicular handle or handle attachment 312. The user may then grasp the exercise apparatus such as shown in FIG. 8B with the housing assembly 140 near or at the user's waist. It will be understood that the housing assembly 140 may be at other locations. The user may then move one of the arm members 120 upward to the position shown in FIG. 8C. The user may then allow the arm member 120 to return to its original position, such as shown in FIG. 8B. This process may be repeated to train the user's upper body. It will be understood that the other side of the user's body may also be trained in this manner by flipping the exercise apparatus. It is contemplated that the user may hold the housing assembly 140 between his or her legs during training in one or more embodiments.

In addition, if a handle attachment 312, such as described above with regard to FIGS. 3A and 3B, is provided, the user may grasp or engage the handle attachment during exercise. FIGS. 9A-9F illustrate various exemplary handle attachments 312 which are contemplated for use with the apparatus. As can be seen, the handle attachments 312 provide locking holes 316 which may be used to secure the handle attachments to an arm member of the apparatus, as described above. Though shown with two locking holes 316 each, it is noted that one or more locking holes may be provided in some embodiments. It is contemplated that handle attachments 312 may provide padded or soft portions for user comfort if desired.

FIG. 9A illustrates a handle attachment 312 having a generally "C" shaped configuration. This allows the handle attachment to have a perpendicular grip 904 which is so named because it is substantially perpendicular to the arm members of the apparatus when attached to the apparatus. The perpendicular grip 904 allows a user to grasp the apparatus in a different manner to perform different body exercises by moving the arm members through the perpendicular grip 904.

FIG. 9B illustrates a handle attachment 312 having a generally open circular portion 916 with a cross bar 908 therein. This handle attachment 312 also is configured to rotate or pivot at various points, as indicated by the arrows. To illustrate, the cross bar 908 and circular portion 916 may rotate about a horizontal axis. In addition, the circular portion 916 may about a vertical axis. As will be understood, various structures may be used to accomplish such rotation. For example, an axle extending into the cross bar 308 may allow rotation of the cross bar. The circular portion 916 may be rotatably mounted within a ring 920 to allow vertical rotation of the circular portion. The ring 920 may be mounted via an axle or rotating mount 912 to allow horizontal rotation of the ring and thus the circular portion 916.

In this embodiment, it is contemplated that the user may grasp the cross bar 908 during training. The rotation of the handle attachment 312 allows the cross bar 908 follow the natural rotation of a users hands during exercise. This is beneficial to user comfort and can prevent injury. In addition, the rotation allows additional types of upper and lower body exercise to be performed with the apparatus. It is noted that other handle attachments 312, such as the other handle attachments described herein, may also include one or more rotating portions to achieve these benefits.

It is contemplated that a handle attachment 312 may be configured to allow a user to exercise other parts of his or her body. In this manner, the exercise apparatus can give the user the functionality of a complete home gym in combination with the portability of the exercise apparatus as set forth herein.

For example, as shown in FIG. 9C, a handle attachment 312 may comprise a curved portion 924 to accept a user's leg or thigh allowing a user to perform leg or thigh exercises. In one exemplary exercise, a user may engage the curved portions 924 of handle attachments 312 with his or her inner leg or thigh. The user may then perform exercises by moving the arm members inward, resisting the outward movement of the arm members, or both.

Figure 9E:
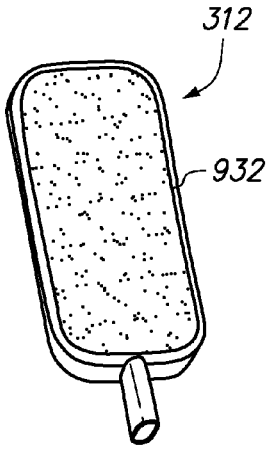
Figure 9F:
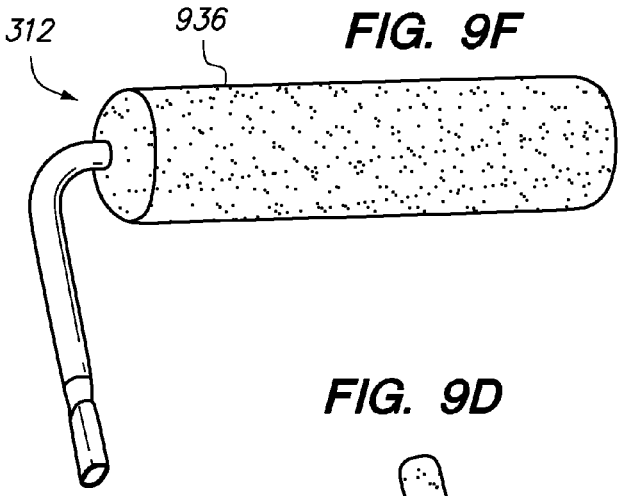
Figure 9D:
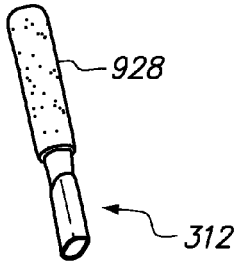

FIG. 9D illustrates a handle attachment 312 having a straight grip 928 which may be grasped by the user's hands or may engage another part of the user's body. FIG. 9E illustrates a handle attachment having a paddle 932 while FIG. 9F illustrates a handle attachment having a bar 936 for engaging a user. The paddle 932, bar 936, or both may have an enlarged size to engage various portions of the user's body. For example, the paddle 932 may be sized to engage a user's thigh or leg. Also, for example, the bar 936 may be sized to extend across the user's torso to allow the exercise apparatus to be used during sit-up type exercises.

Figure 9G:
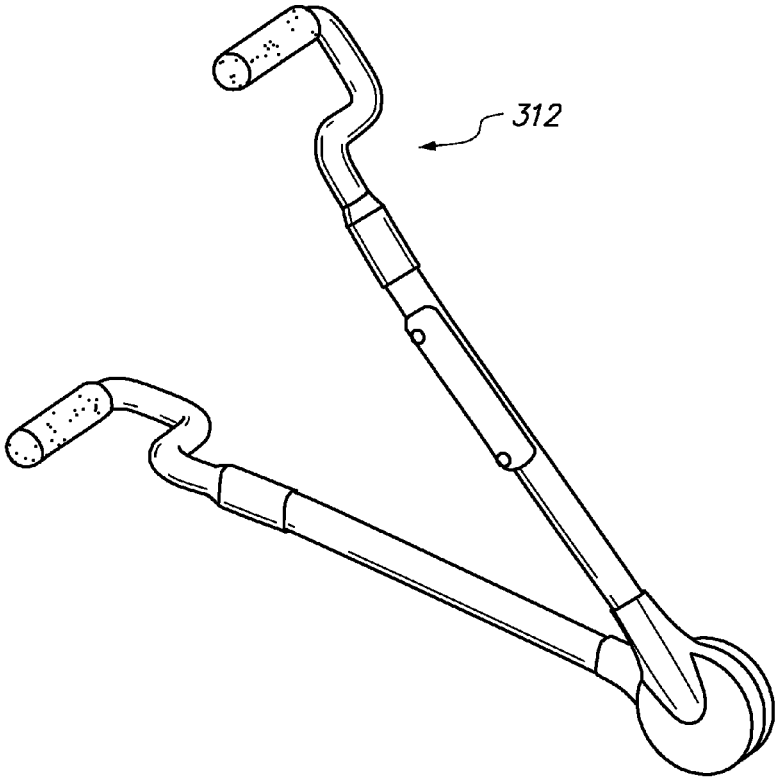
FIGS. 9G-9I are perspective views illustrating exemplary handle attachments attached to an exemplary exercise apparatus.
Figure 9H:
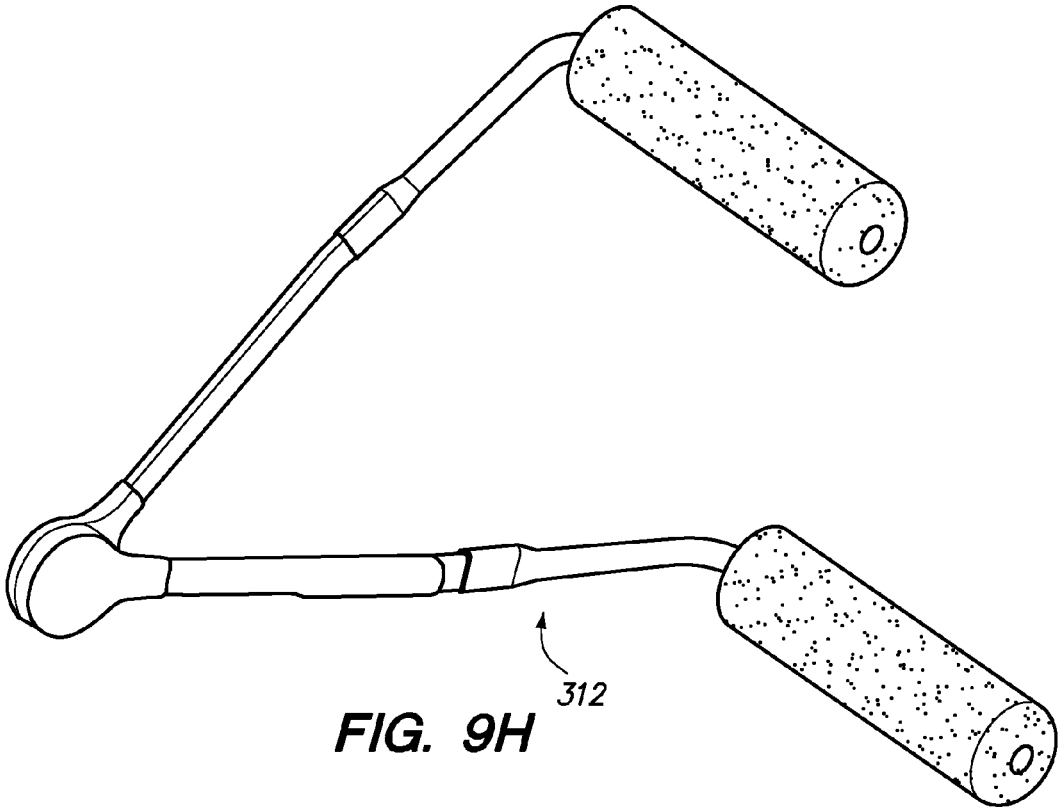
Figure 9I:
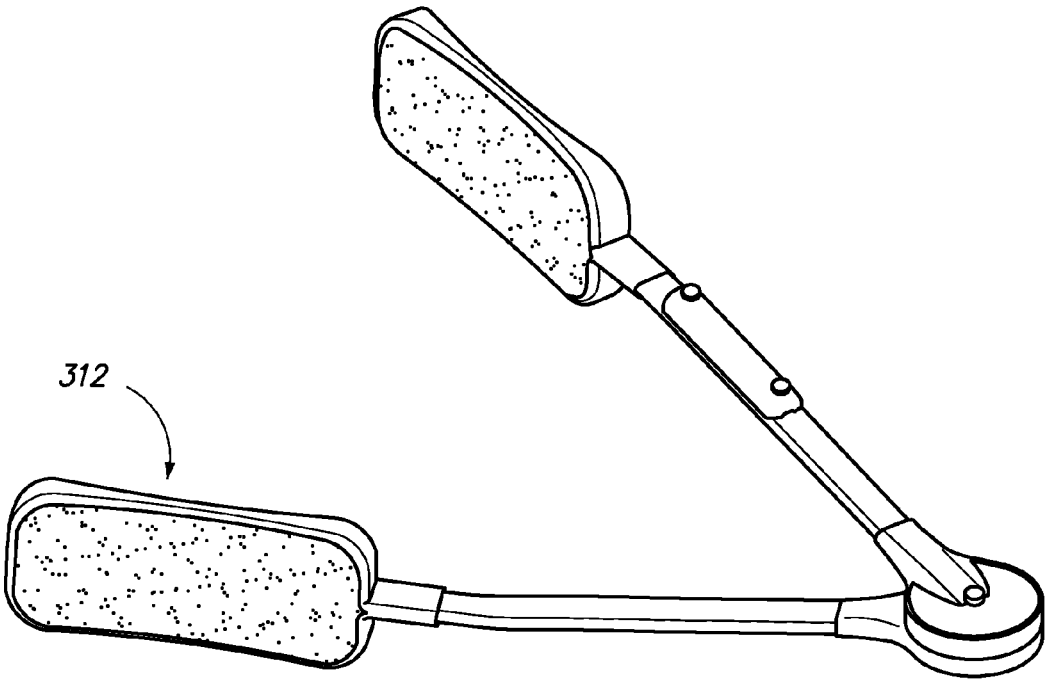

FIGS. 9G-9I illustrate exemplary handle attachments 312 as they may be attached to the exercise apparatus. Though the figures show the same handle attachment 312 for each arm member 120,128, it will be understood that different handle attachments 312 may be used on each arm member 120,128. As can be seen, the use of various handle attachments 312 allows various body exercises to be performed. In addition, the various handle attachments 312 allow the exercise apparatus to be used for other exercises. In this manner, the exercise apparatus operates as a full body exercise apparatus.

Figure 10A:
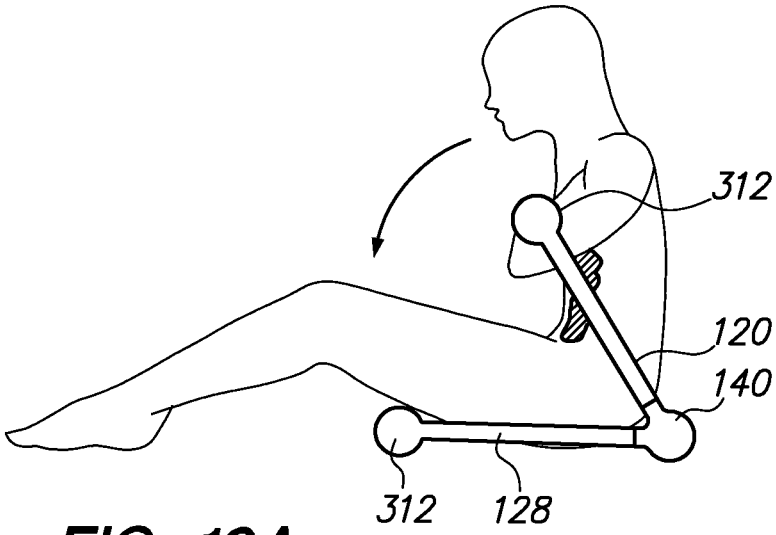
FIGS. 10A-10N illustrate exemplary full body exercises performed with an exemplary exercise apparatus.
Figure 10B:
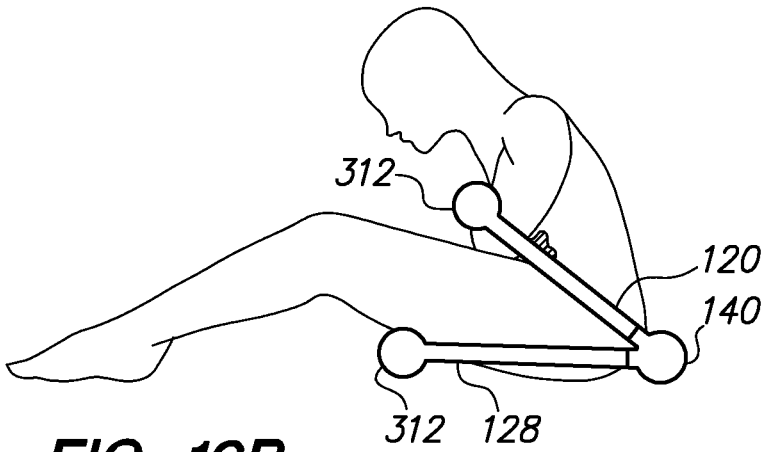

Some exemplary exercises that may be performed with the exercise apparatus will now be described. Muscles or muscle groups that may be used/trained during the exercises are shaded in the figures. FIGS. 10A-10B illustrate the exercise apparatus being used to enhance abdominal exercises. As can be seen, the exercise apparatus has been configured with a handle or handle attachment 312, such as that shown in FIG. 9F for this exercise. In FIG. 10A the user engages a first arm member 120 with his or her torso while holding the second arm member 128 beneath his or her legs. The user may then perform a sit-up like maneuver to move the arm members 120,128 closer together, such as shown in FIG. 10B. Because the user must overcome the resistance provided by the arm members 120,128 training of the user's abdominal and other muscles is enhanced by the exercise apparatus. It is noted that as the user returns form the position of FIG. 10B to that of FIG. 10A, the user may resist the return force of the arm members 120,128 further training his or her abdominal muscles.

Figure 10C:
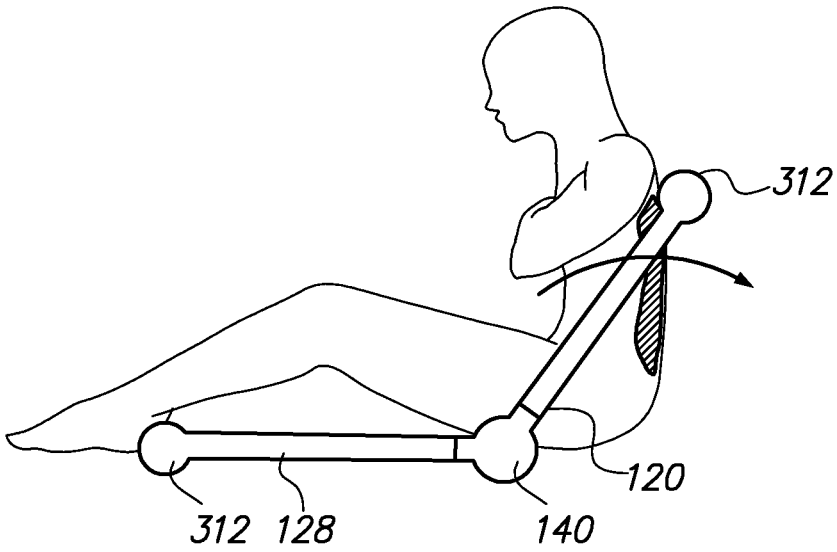
Figure 10D:
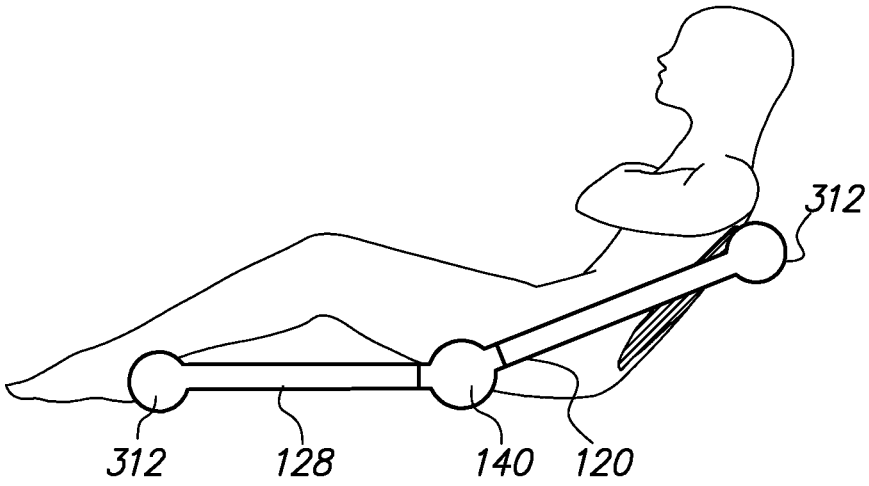

FIGS. 10C-10D illustrate a back exercise performed with the exercise apparatus. In FIG. 10C, the user engages a first arm member 120 of the exercise apparatus with his or her back. The second arm member 128 may be held beneath the user's foot or leg. To perform a back exercise, the user may then recline, forcing the arm members 120,128 apart as shown in FIG. 10D. Again, the user must overcome the resistance of the arm members 120,128 thus enhancing the back exercise. The user may also resist the return motion of the arm members 120,128 from their position in FIG. 10D to their position in FIG. 10C.

Figure 10E:
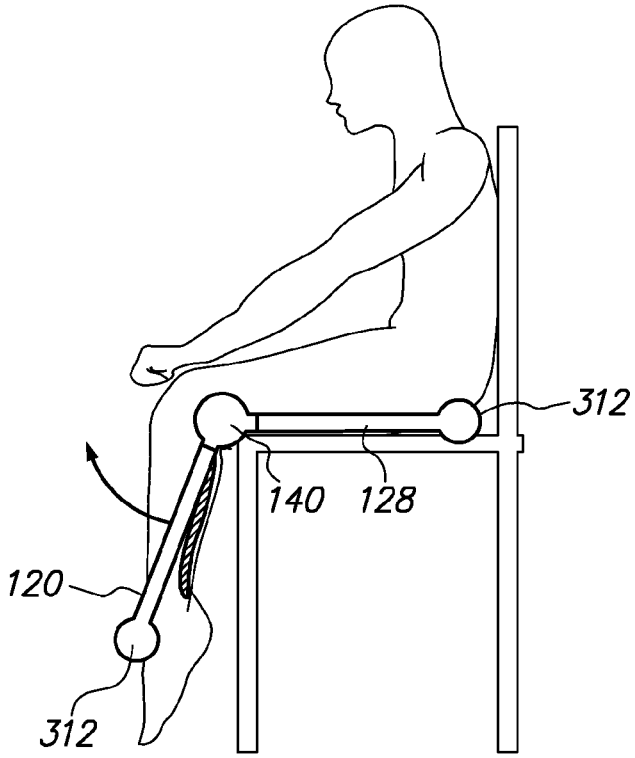
Figure 10F:
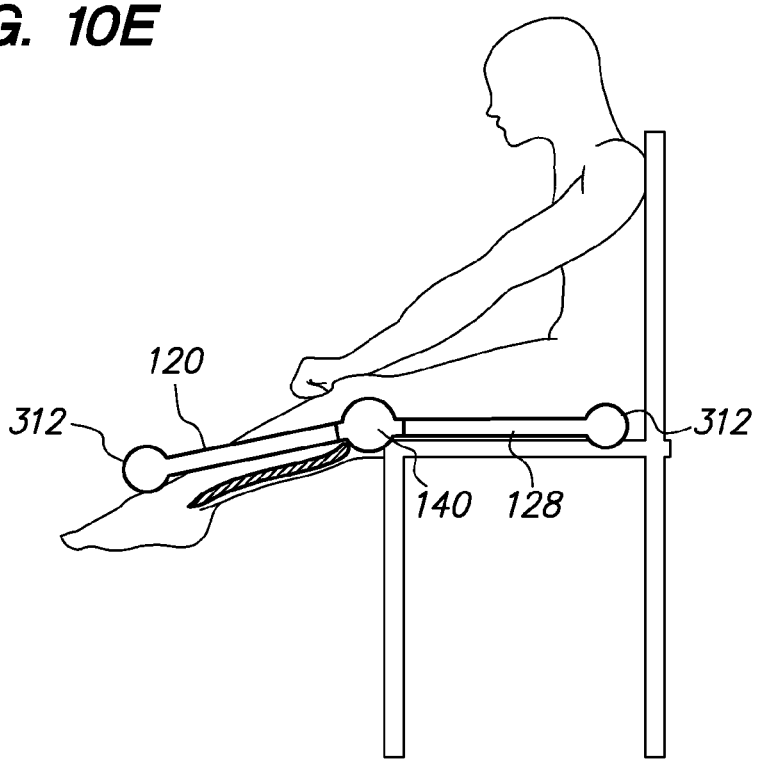

FIGS. 10E-10F illustrate a leg exercise which focuses on the user's calf muscles. As can be seen in FIG. 10E, the user may engage a first arm assembly 120 with the front of the user's legs or foot and hold the second arm assembly 128 by sitting on it or by holding it beneath his or her thighs. The user may then extend his or her legs to move the arm members 120,128 apart, such as shown in FIG. 10F. The user overcomes the resistance of the arm members 120,128 thus training his or her legs. It is noted that the user may perform this (and similar) exercises with one leg or both legs, as the user desires.

Figure 10G:
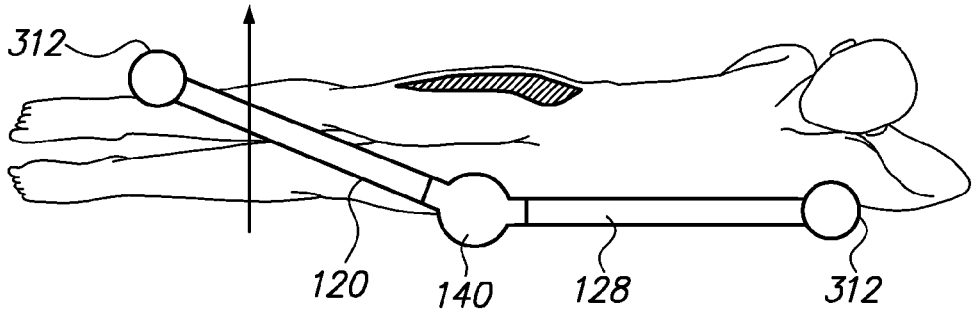
Figure 10H:
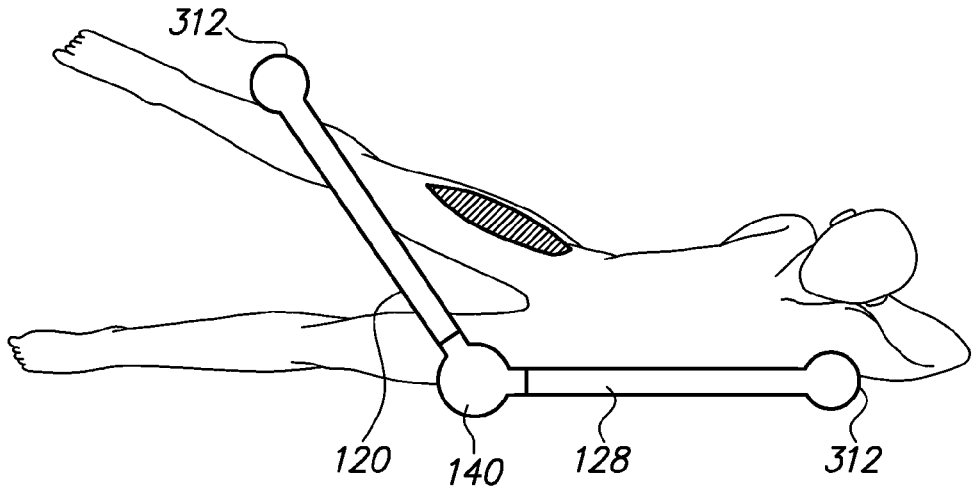

In FIGS. 10G-10H an exemplary thigh exercise is illustrated. As shown in FIG. 10G, the user may engage a first arm member 120 with the outer portion of one of his or her legs or feet while holding a second arm member 128 with his or her torso or arm. A thigh exercise may be performed by moving the user moving his or her leg outward to move the arm members 120,128 apart, such as shown in FIG. 10H. The user may then allow the arm members 120,128 to return to their position such as shown in FIG. 10G. As can be seen, the user exercises his or her outer thigh muscles by performing this exercise.

Figure 10I:
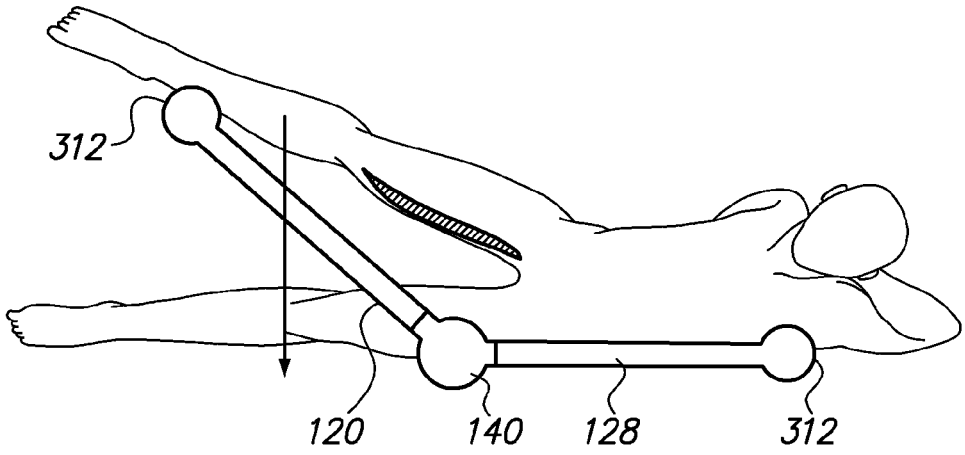
Figure 10J:
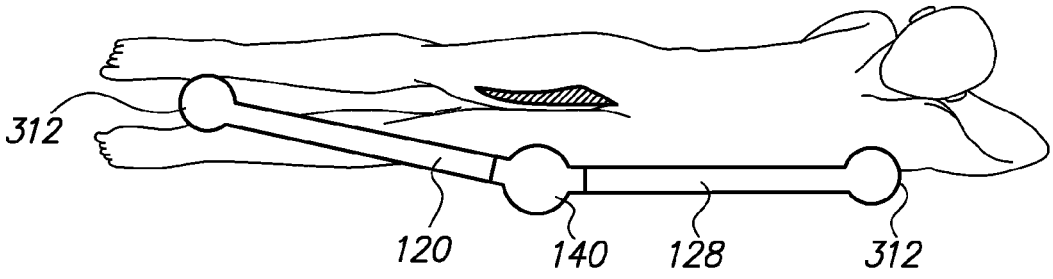

FIGS. 10I-10J illustrate another thigh exercise, but focused on the muscles of the inner thigh. As can be seen from FIG. 10I, the user may engage a first arm member 120 with the inner portion of one of his or her legs while holding a second arm member 128 with his or her torso or arm. The user may then move his or her leg towards his or her other leg to extend the arm members 120,128 farther apart, such as shown in FIG. 10J. The user may then resist the return of the first arm member 120 to its position in FIG. 10I. In this manner, the user may exercise or train his or her inner thigh muscles.

Figure 10K:
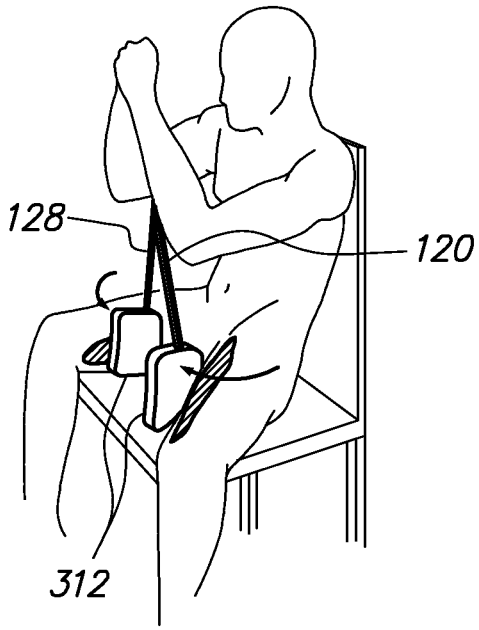
Figure 10L:
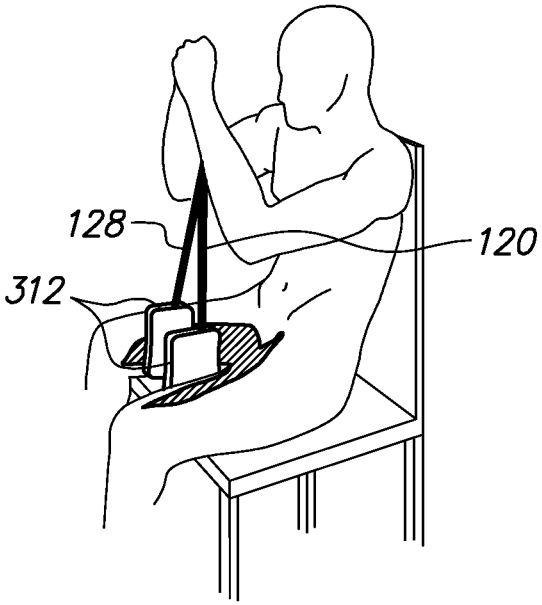

FIGS. 10K-10L illustrate a variation on inner thigh exercises that may be performed with the exercise apparatus. As can be seen, the exercise apparatus has been configured with handles or handle attachments 312 comprising paddles, such as shown in FIG. 9E. The user may engage the paddles with his or her inner thighs, such as shown in FIG. 10K. The user may also hold onto the housing assembly 140, though this is not always necessary. To exercise the inner thigh muscles, the user may move his or her legs together and accordingly move the arm members 120,128 together, such as shown in FIG. 10L. As part of the exercise, the user may also resist the return motion of the arm members 120,128 to their original position, such as shown in FIG. 10K.

Figure 10M:
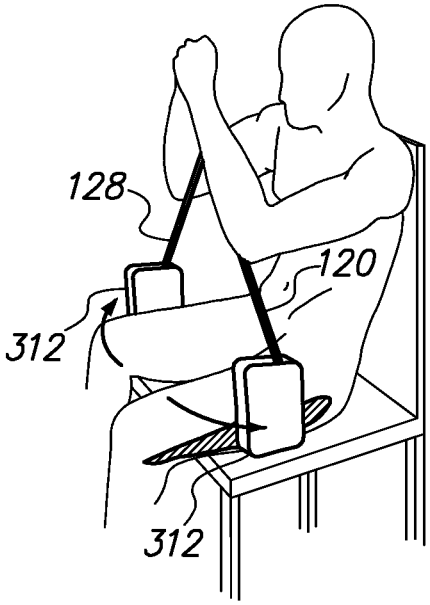
Figure 10N:
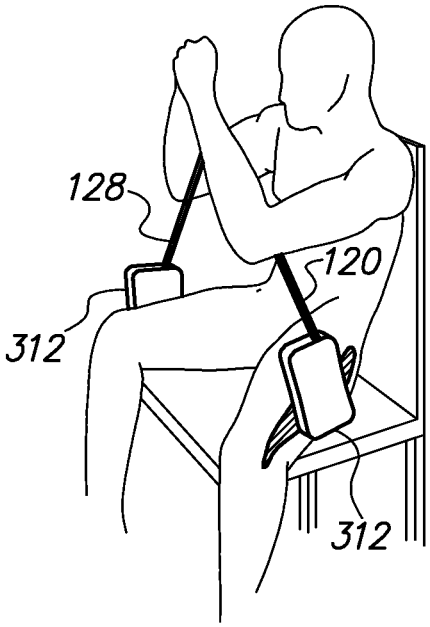

Likewise, the paddles may also be used to exercise the outer thigh muscles. FIGS. 10M-10N illustrate an exemplary outer thigh exercise utilize an exercise apparatus configured with handles or handle attachments 312 comprising paddles. As shown in FIG. 10M, the user may engage the arm members 120,128 by placing them adjacent his or her outer thighs. The user may also hold on to the housing assembly 140, though this is not required. Then, the user may move his or her legs outward, such as shown in FIG. 10N, to move the arm members 120,128 outward. This overcomes the resistance provided by the arm members 120,128 and trains the user's outer thigh muscles. The user may also resist the return motion of the arm members 120,128 to their original position, such as illustrated in FIG. 10M, as part of the exercise.

It will be understood that the exercises set forth herein may be repeated as desired. In addition, it will be understood that training of various nearby muscles or muscles associated with various body motions will also occur be trained though the exercise set forth herein have generally been described as targeting particular muscles. Moreover, as can be seen, the user's muscles may be trained by moving the arm members 120,128 as well as by resisting the return motion of the arm members.

The apparatus herein provides advantages over traditional exercise devices. One advantage is that the apparatus herein utilizes fewer moving parts than traditional devices. For example, some traditional devices utilize various gears, chains, and springs to provide resistance to the movement of arm members. With fewer moving parts, durability and maintenance of the apparatus are improved.

The apparatus also allows adjustment of the amount of resistance or force provided as well as the positioning of the arm members. This is advantageous because the apparatus may accommodate users of various sizes, strengths, and skill levels while allowing various exercises to be performed. Also, one or more handle attachments may be used with the apparatus to accommodate different users and for various types of exercises to be performed.

The tensioning member of the apparatus herein provides for quiet or substantially silent operation. This is especially so when compared to a spring tensioning member. Such a tensioning member also provides durability. In addition, the adjustment holes of the tensioning member allow the level of resistance provided by the apparatus to be conveniently adjusted as desired.

Further, the positioning assembly allows a user to easily adjust the position of the arm members relative to one another for various types of full body exercises. As stated, the user may move the switch of a positioning assembly, rotate an arm member, and release the switch to secure the arm member in the desired position. The positioning assembly's switch may be conveniently located on an arm member, such as near a handle portion, to allow position adjustments to be quickly and easily made. For example, the positioning assembly herein may be operated with a single action of a user's finger or thumb.

In one or more embodiments, a grip bar or stabilization bar may be provided. For example, as shown in FIGS. 11A-11D, a stabilization bar 1104 may be attached to the housing assembly 140 to allow a user to stabilize the exercise apparatus during exercise. The user may grasp or otherwise engage the stabilization bar 1104 to hold at least a portion of the apparatus in position during exercise, in one or more embodiments. For example, the user may hold onto one or more stabilization bars while moving the arm members 120, 128 with the user's feet or legs to exercise the user's lower body.

Figure 11A:
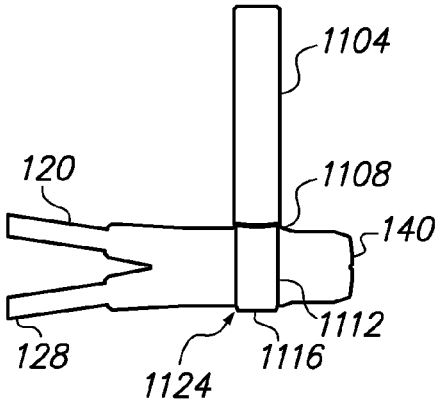
FIGS. 11A-11F illustrate exemplary stabilization bars attached to an exemplary exercise apparatus.
Figure 11C:
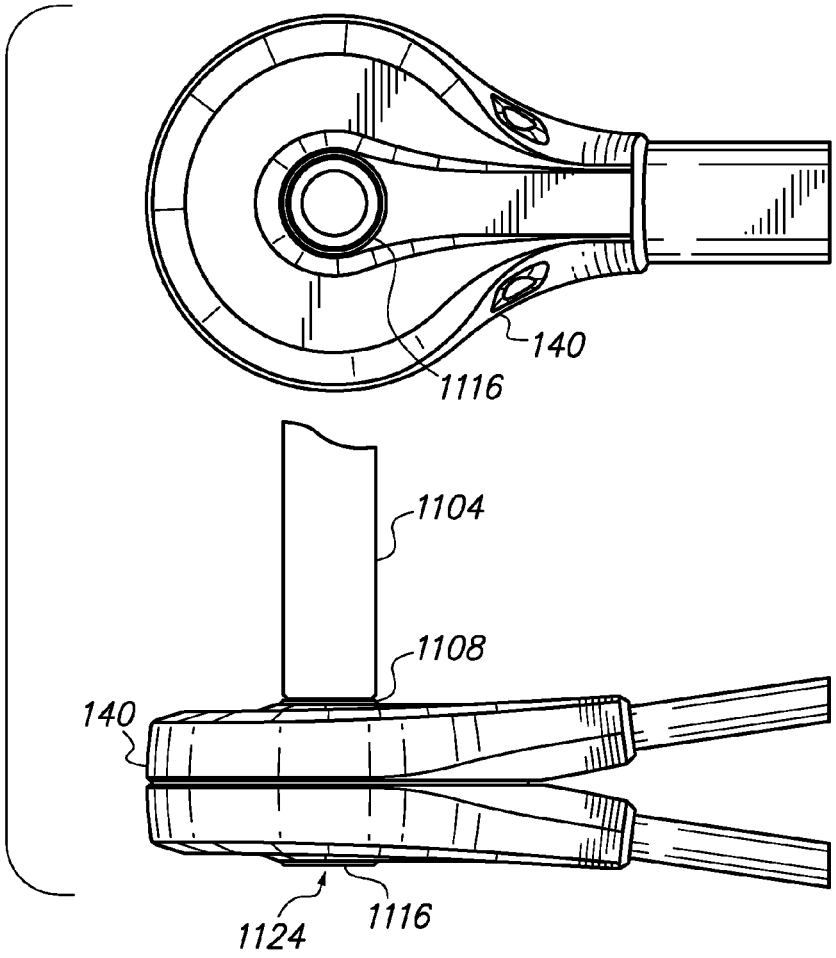
Figure 11B:
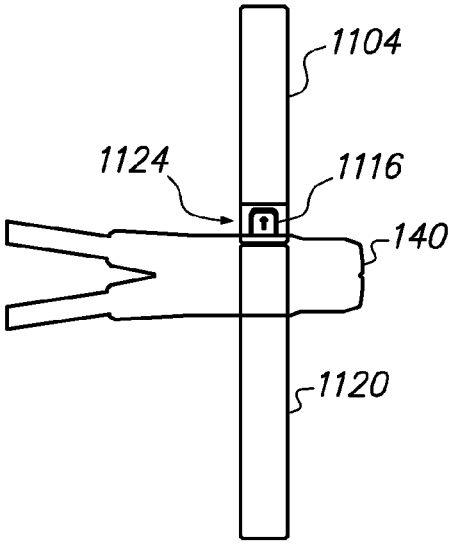

As shown in FIG. 11A, the stabilization bar 1104 may extend outward from the housing assembly 140. In one or more embodiments, the stabilization bar 1104 may extend from a central portion of the housing assembly 140. In addition, multiple stabilization bars 1104 may be provided in one or more embodiments. For example, a stabilization bar 1104 may extend from both sides of a housing assembly 140 in one or more embodiments, such as illustrated in FIG. 11B. Of course, the stabilization bar 1104 may alternatively extend from either one of the sides of the housing assembly 140. In addition, though shown as generally perpendicular from the housing assembly 140, it is contemplated that the stabilization bar 1104 may extend at various angles relative to the housing assembly 140.

In one or more embodiments, to extend from both sides of a housing assembly 140, the stabilization bar 1104 may extend through the housing assembly 140 such as shown in FIG. 11B. A first side or portion of the stabilization bar 1104 may be secured to the housing assembly 140 while another side or portion 1120 of the stabilization bar may be secured to the first portion of the stabilization bar to extend through the housing assembly. Alternatively, two (or more) stabilization bars 1104 may be attached to the sides of the housing assembly 140 to thereby extend from both sides of the housing assembly.

A stabilization bar 1104 may be removable in one or more embodiments. This allows full body exercises to be performed with or without stabilization bars 1104 as desired by a user. Also, this allows stabilization bars 1104 of various sizes, shapes, and configurations to be attached as desired or for one or more particular exercises.

The stabilization bar 1104 may be removably attached to the exercise apparatus in various ways. As shown in FIG. 11A for example, the stabilization bar 1104 has been inserted into the housing assembly 140 through a collar 1108 and secured by an attachment mechanism 1124 of the housing assembly. A portion of the stabilization bar 1104 may have a reduced size or diameter in one or more embodiments to fit through the collar 1108, though this is not necessary in all embodiments. In addition, it is noted that a collar 1108 need not be provided in all embodiments, as the stabilization bar 1104 may be inserted into a collarless opening of the housing assembly 140. The collar 1108 is beneficial in guiding the stabilization bar 1104 into the housing assembly 140 in some embodiments however.

Figure 11D:
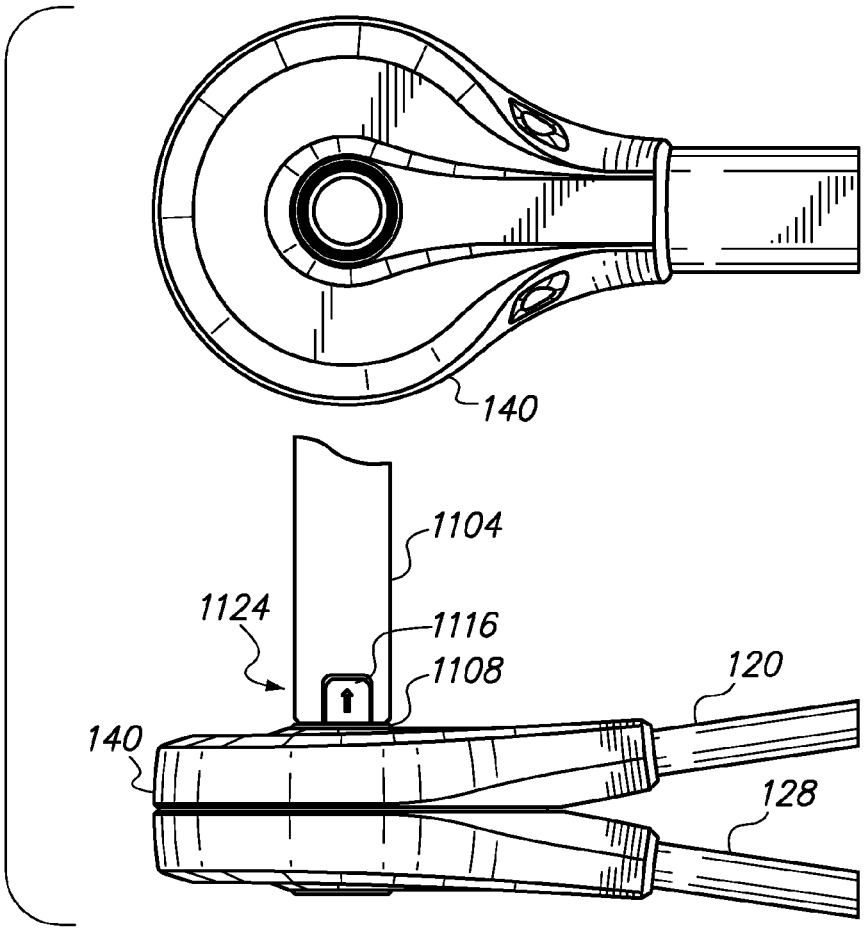
Figure 11E:
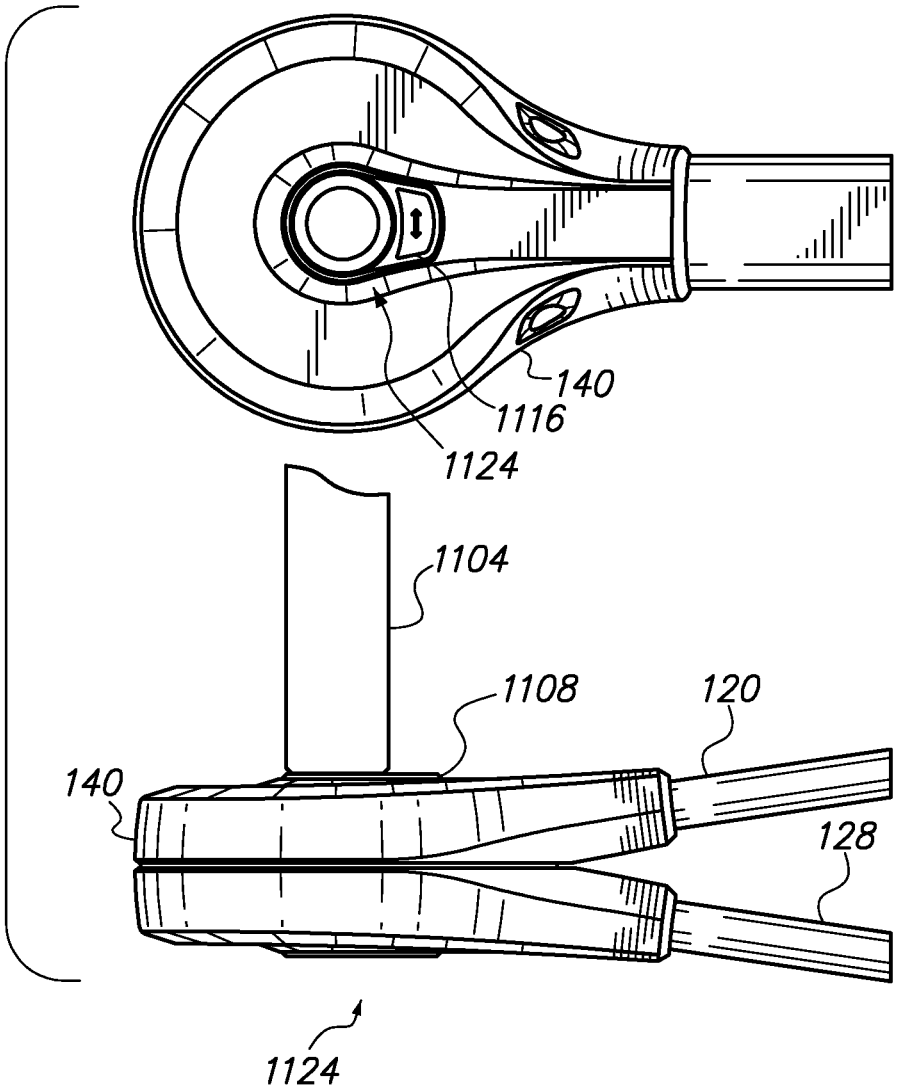
Figure 11F:
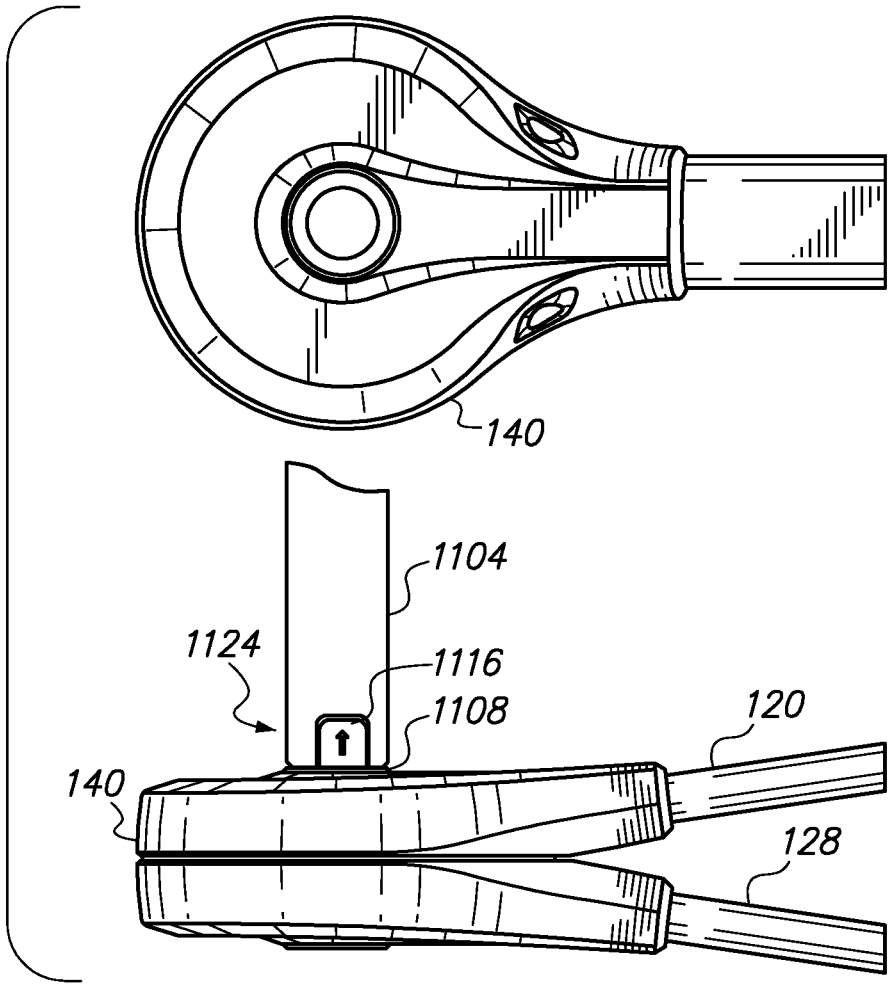

The attachment mechanism 1124 may comprise various structures and/or devices which secure the stabilization bar 1104 to the housing assembly. For example, the attachment mechanism 1124 may be a threaded connector that may be rotated to secure the stabilization bar 1104. The attachment mechanism 1108 may also be configured as a clamping, clipping, or locking structure which secures the stabilization bar 1104. In one or more embodiments, the attachment mechanism 1124 may comprises a push button 1116, such as shown in FIGS. 11C and 11F, which permit a user to release the stabilization bar 1104 from the housing assembly 140. The push button 1116, when pushed, may cause a locking structure of the attachment mechanism 1124 to release the stabilization bar 1104. As can be seen from FIG. 11D, the push button 1116 may be configured in various ways and positioned at various locations. In the embodiment of FIG. 11D for example, the push button 1116 has been located on the stabilization bar 1104. FIG. 11E shows another exemplary location for a push button 1116 on a housing assembly 140.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. An exercise apparatus comprising:

a housing assembly comprising:

a first housing unit and a second housing unit;

an axial stem extending from the first housing unit to the second housing unit; and a tension drum having a central opening and one or more positioning holes, the tension drum rotatably mounted on said axial stem by said central opening;

a first arm extending outward from the first housing unit and comprising a hollow body;

an elastic member within the hollow body of the first arm, a first portion of the elastic member secured to a portion of the first arm, a second portion of the elastic member attached to the tension drum, whereby the elastic member is stretched between the first portion and second portion to provide resistance to a user during exercise;

a second arm extending outward from the second housing unit and comprising a hollow body; and a retractable pin within the hollow body of the second arm, the pin configured to insert into one of the one or more positioning holes to secure the second arm member in position relative to the second housing unit.

2. The exercise apparatus of claim 1, wherein the elastic member is attached to the tension drum by an attachment cable.

3. The exercise apparatus of claim 1, wherein the elastic member comprises a plurality of adjustment holes configured to secure the first portion of the elastic member to the first arm by accepting a securing pin therein.

4. The exercise apparatus of claim 3, wherein the first arm comprises one or more openings through which the securing pin may enter the hollow body of the first arm.

5. The exercise apparatus of claim 1 further comprising:

a movable switch on the second arm, the movable switch configured to allow the user to retract the retractable pin; and a support rod connecting the movable switch to the retractable pin, the support rod located within the hollow body of the second arm.

6. The exercise apparatus of claim 1 further comprising a first handle and a second handle, the first handle removably secured to a distal end of the first arm, the second handle removably secured to a distal end of the second arm.

7. The exercise apparatus of claim 1 further comprising a first handle attached to a distal end of the first arm, the first handle comprising a user graspable bar mounted to the distal end of the first arm by a rotating mount.

8. An exercise apparatus comprising:

a housing comprising a first portion and a second portion, the first portion rotatable relative to the second portion;

an axle within the housing, the axel extending between the first portion and the second portion of the housing;

a tension drum within the housing, the tension drum having an opening therein to rotatably mount the tension drum to the axle;

a first arm extending from the first portion of the housing;

a resilient member secured at a first point to the first arm and connected at a second point to the tension drum; and a second arm extending from the second portion of the housing, the tension drum secured to the second arm such that the tension arm rotates with the second arm.

9. The exercise apparatus of claim 8, wherein the resilient member is mounted external to the first arm.

10. The exercise apparatus of claim 8, wherein the resilient member is within a hollow section of the first arm.

11. The exercise apparatus of claim 8, wherein the tension drum comprises one or more openings and is secured to the second arm by a retractable pin that is insertable into the one or more openings.

12. The exercise apparatus of claim 8, wherein the resilient member comprises a plurality of adjustment holes configured to accept a securing pin to secure the resilient member to the first arm at the first point of the resilient member.

13. The exercise apparatus of claim 8, wherein the first arm comprises a plurality of openings through which a securing pin may be inserted into the resilient member to secure the resilient member to the first arm at the first point of the resilient member.

14. The exercise apparatus of claim 8, wherein the tension drum is cylindrical in shape.

15. The exercise apparatus of claim 8, wherein the resilient member is connected to the tension drum by a cable.

* * * * *